US007232201B2

(12) United States Patent
Inde et al.

(10) Patent No.: US 7,232,201 B2
(45) Date of Patent: Jun. 19, 2007

(54) INK SUPPLY AMOUNT ADJUSTMENT METHOD AND APPARATUS FOR PRINTING PRESS

(75) Inventors: Akihiro Inde, Ibaraki (JP); Hideki Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 280 days.

(21) Appl. No.: 11/134,648

(22) Filed: May 19, 2005

(65) Prior Publication Data

US 2005/0264594 A1 Dec. 1, 2005

(30) Foreign Application Priority Data

May 25, 2004 (JP) ..... 2004-154592

(51) Int. Cl.
*B41J 29/393* (2006.01)

(52) U.S. Cl. ..... 347/19

(58) Field of Classification Search ..... 347/19, 347/14, 15

See application file for complete search history.

(56) References Cited

U.S. PATENT DOCUMENTS 6,871,926 B2 * 3/2005 Adkins et al. ..... 347/7
6,893,108 B2 * 5/2005 Choi et al. ..... 347/19
6,962,399 B2 * 11/2005 Anderson et al. ..... 347/14

FOREIGN PATENT DOCUMENTS

JP 2003-118077 4/2003

* cited by examiner

*Primary Examiner*—Lamson Nguyen
(74) *Attorney, Agent, or Firm*—Blakely Sokoloff Taylor & Zafman

(57) ABSTRACT

In an ink supply amount adjustment method for a printing press, one of a density value and a color value of a printing product is measured. The difference between the measurement value and a preset reference value is obtained as a measurement difference. The first error ratio allowed with respect to the preset reference value is set as a first allowable ratio. The first allowable difference is obtained from the preset reference value and the set first allowable ratio. An ink supply amount is adjusted on the basis of the obtained measurement difference and the obtained first allowable difference. An ink supply amount adjustment apparatus is also disclosed.

18 Claims, 33 Drawing Sheets

INK SUPPLY AMOUNT ADJUSTMENT METHOD AND APPARATUS FOR PRINTING PRESS

BACKGROUND OF THE INVENTION

The present invention relates to an ink supply amount adjustment method and apparatus for a printing press, which adjust the ink supply amount to a printing plate on the basis of the density value or color value of a printing product.

FIG. 16 shows the main part of the inking device (inker) in each color printing unit of a web offset printing press. Referring to FIG. 16, reference numeral 1 denotes an ink fountain; 2, ink stored in the ink fountain 1; 3, an ink fountain roller which forms part of the ink fountain 1; 4, a plurality of ink keys juxtaposed in the axial direction of the ink fountain roller 3; 5, an ink ductor roller which supplies the ink from the ink fountain roller 3 to ink rollers 6 by swinging between these rollers 3 and 6; and 8, a plate cylinder on which a printing plate 7 is mounted on its outer surface, and to which the ink is supplied from the ink rollers 6. An image is printed on the printing plate 7.

In this inking device, the ink 2 in the ink fountain 1 is supplied to the ink fountain roller 3 through the gap between the plurality of ink keys 4-1 to 4-n and the ink fountain roller 3. The ink supplied to the ink fountain roller 3 is supplied to the printing plate 7 through the ink rollers 6 by the duct operation of the ink ductor roller 5. The ink supplied to the printing plate 7 is transferred onto a printing paper sheet through a blanket cylinder (not shown).

FIG. 17 shows a printing product printed by this printing press. A band-shaped color bar 9-2 is printed on the margin portion of a printing product 9 except an image region 9-1 in the widthwise direction of the paper sheet. In general four-color printing, the color bar 9-2 includes a region S1 and regions S2 to Sn including density measurement patches (solid patches at a percent dot area of 100%) 9*a*1, 9*a*2, 9*a*3, and 9*a*4 of black, cyan, magenta, and yellow. The regions S1 to Sn correspond to the respective key zones of plurality of ink keys 4-1 to 4-n in each color printing unit of the printing press.

[Color Matching]

A reference density value is set in advance for each color (black, cyan, magenta, or yellow) printing unit. In printing the printing product 9, a color matching operation is done to make the density value of each color coincide with the set reference density value. This color matching operation is executed by the ink supply amount adjustment apparatus during final printing or before final printing on the basis of the density of a density measurement patch 9*a* (9*a*1, 9*a*2, 9*a*3, or 9*a*4) of each color in the color bar 9-2 printed on the printing product 9. "During final printing" means a period of printing printed matters as products. "Before final printing" means a period of preparation for printing when ink supply amount is adjusted while printing, prior to printing printed matters as products.

An ink supply amount adjustment operation will now be described by using the region S1 in the printing product 9 as a representative. The density value of the density measurement patch 9*a* (9*a*1, 9*a*2, 9*a*3, or 9*a*4) of each color on the printing product 9, which is extracted before or during final printing, is measured. The difference between the measured density value of each color and the preset reference density value of each color is obtained. The adjustment amount of the opening ratio of the ink key 4-1 (the adjustment amount of ink supply amount to the region S1) in each color printing unit is then obtained from the obtained density difference of each color. The resultant adjustment amounts (reference correction amounts) are multiplied by a unique coefficient (control ratio) to obtain a correction amount. The resultant correction amount is fed back to adjust the opening ratio of the ink key 4-1 in each color printing unit.

In a similar way, for regions S2 to Sn as well, the adjustment amounts of the opening ratios of the ink keys 4-2 to 4-n (the adjustment amounts of ink supply amounts to the regions S2 to Sn) in each color printing unit are obtained. The resultant adjustment amounts (reference correction amounts) are multiplied by a control ratio to obtain a correction amount. The resultant correction amount is fed back to adjust the opening ratios of the ink keys 4-2 to 4-n in each color printing unit.

Note that, in adjusting the opening ratios of the ink keys 4-1 to 4-n in each color printing unit, the only allowable density difference of each color is defined for the density difference (measured density difference) between the measured density value of each color and the preset reference density value of each color. The ink supply amount is adjusted for the corresponding ink key when the obtained measured density differences are larger than the allowable density difference (Japanese Patent Laid-Open No. 2003-118077).

In the above-described conventional ink supply amount adjustment method, an operator arbitrarily sets an allowable density difference for a measured density difference, for each color. When using ink, e.g., process ink of black, cyan, magenta, or yellow, which is generally used in printing, the operator can experimentally set the allowable density difference as an almost adequate value. However, when using ink (special ink) of a special color, which has never (rarely) been used, the operator does not obtain the adequate allowable density difference of each color.

Hence, when a wrong allowable density difference is set, in some cases, the ink supply amount is not corrected although it must be corrected. Alternatively, in some cases, the ink supply amount is corrected although it need not be corrected. This causes the hunting phenomenon (the color tone becomes unstable because of the variation in color density on the printing product) of the ink film thickness on the paper sheet, thus posing a problem. In addition, assume that the allowable density difference is small, and the ink supply amount adjustment interval (printing product sampling interval) is short. While the preceding adjustment of the ink supply amount is not sufficiently reflected on the printing product, the next ink supply amount adjustment is done. In this case, a hunting phenomenon of the ink thickness on the paper sheet also occurs.

In addition, the density value of a specific part of the printing product may temporarily largely vary due to an unexpected accident (paper fold error, paper breakage, or smear) on the printing product. In this case, when the ink supply amount is adjusted from the measured density difference as usual, the ink supply amount is adjusted to a value largely shifted from what the ink supply amount should be. As a result, the amount of wasted paper increases, thus posing a problem.

SUMMARY OF THE INVENTION

It is an object of the present invention to provide an ink supply amount adjustment method and apparatus for a printing press, which can automatically set the adequate value of the allowable density difference or allowable color difference, regardless of the color of the ink.

It is another object of the present invention to provide an ink supply amount adjustment method and apparatus for a printing press, which can prevent the occurrence of the hunting phenomenon of an ink thickness on a paper sheet, when the allowable density difference or allowable color difference is small.

It is still another object of the present invention to provide an ink supply amount adjustment method and apparatus for a printing press, which can suppress the amount of wasted paper even when an unexpected accident has occurred on a printing product.

In order to achieve the above objects according to the present invention, there is provided an ink supply amount adjustment method for a printing press, comprising the steps of measuring one of a density value and a color value of a printing product, obtaining a difference between the measurement value and a preset reference value, as a measurement difference, setting a first error ratio allowed with respect to the preset reference value, as a first allowable ratio, obtaining a first allowable difference from the preset reference value and the set first allowable ratio, and adjusting an ink supply amount on the basis of the obtained measurement difference and the obtained first allowable difference.

DETAILED DESCRIPTION OF THE PREFERRED EMBODIMENTS

The present invention will be described below in detail with reference to accompanying drawings.

First Embodiment

Figure 1:
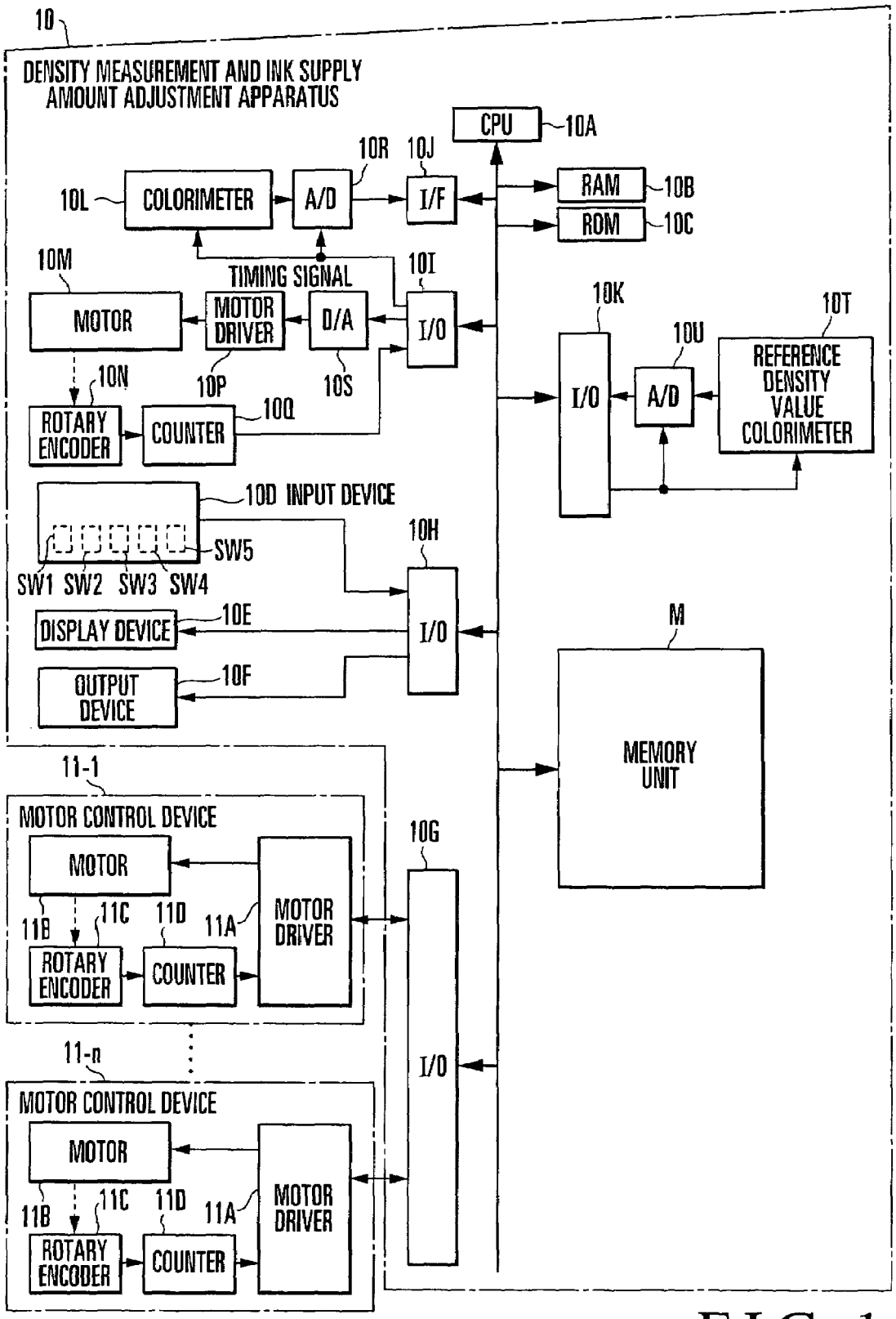
FIG. 1 is a block diagram showing an ink supply amount adjustment apparatus according to the first embodiment of the present invention.

A density measurement and ink supply amount adjustment apparatus (to be simply referred to as an ink supply amount adjustment apparatus hereinafter) according to the first embodiment of the present invention will be described below with reference to FIGS. 1 and 2. As shown in FIG. 1, an ink supply amount adjustment apparatus 10 comprises a CPU (Central Processing Unit) 10A, RAM (Random Access Memory) 10B, ROM (Read Only Memory) 10B, ROM (Read Only Memory) 10C, input device 10D, display device 10E, output device 10F, input/output interfaces (I/Os) 10G to 10K, calorimeter 10L, calorimeter moving motor 10M, rotary encoder 10N, motor driver 10P, counter 10Q, A/D converter 10R, D/A converter 10S, reference density value measurement colorimeter 10T, A/D converter 10U, and memory unit M.

The CPU 10A operates in accordance with a program stored in the ROM 10C while obtaining various kinds of input information given through the interfaces 10G to 10K and accessing the RAM 10B or memory unit M. The input device 10D has a printing state input switch SW1, density measurement start switch SW2, control end switch SW3, allowable value condition input switch SW4, reference density value measurement switch SW5, and the like. The rotary encoder 10N generates a rotation pulse for each predetermined number of revolutions (angle) of the motor 10M and outputs the pulse to the counter 10Q.

A plurality of ink key driving motor control devices 11-1 to 11-n are arranged in correspondence with the ink keys 4-1 to 4-n of the respective colors shown in FIG. 14. The ink key driving motor control devices 11-1 to 11-n individually adjust the opening ratios of the ink keys 4-1 to 4-n for an ink fountain roller 3. Each of the motor control devices 11-1 to 11-n comprises an ink key driving motor driver 11A, ink key driving motor 11B, rotary encoder 11C, and counter 11D. The motor control devices 11-1 to 11-n are connected to the CPU 10A of the ink supply amount adjustment apparatus 10 through the interface 10G. The rotary encoder 11C generates a rotation pulse for each predetermined number of revolutions (angle) of the motor 11B and outputs the pulse to the counter 11D.

Figure 2:
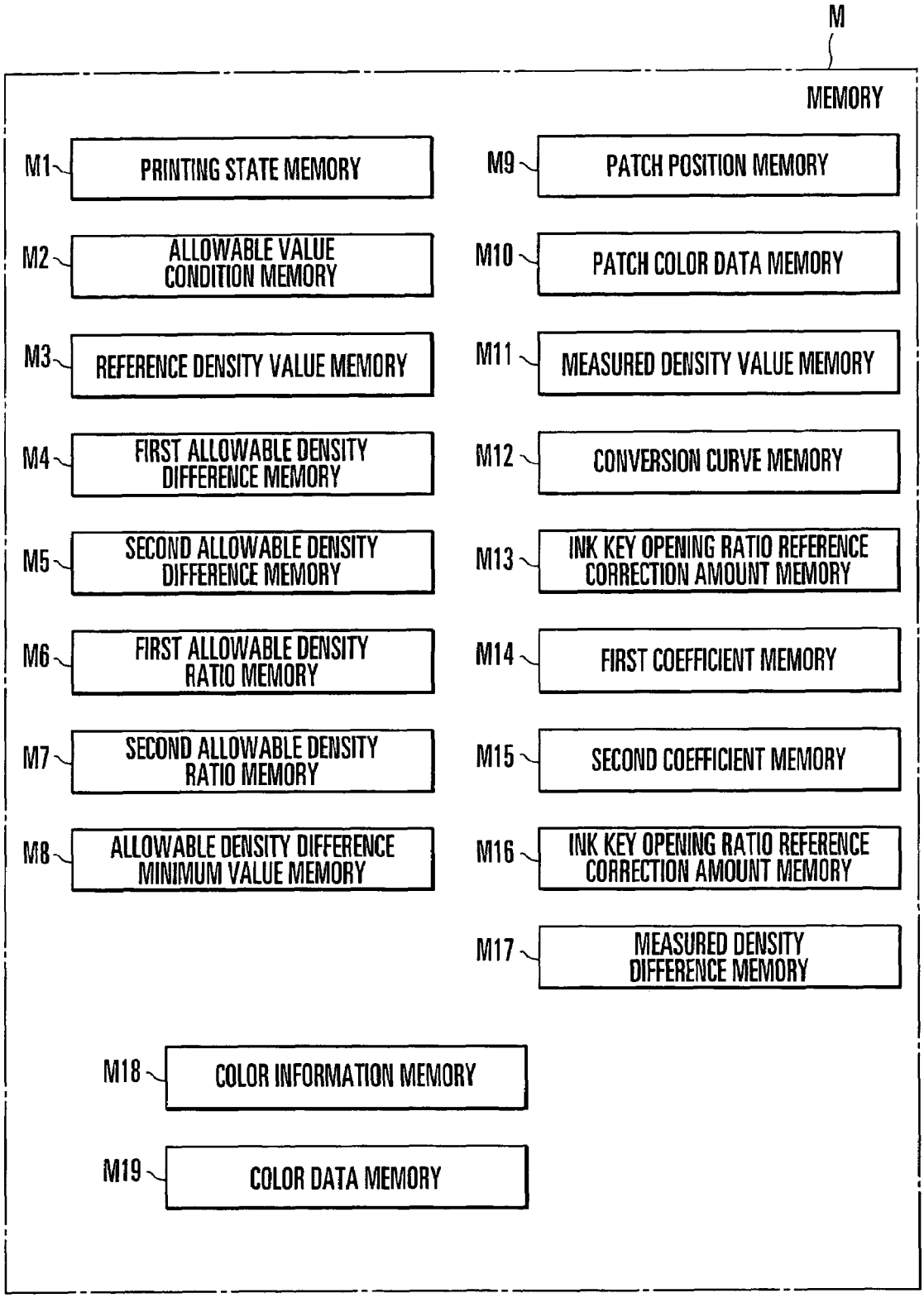
FIG. 2 is a view showing the structure of a memory unit shown in FIG. 1.

The memory unit M comprises memories M1 to M19 as shown in FIG. 2. The ON/OFF state of the printing state input switch SW1 in the input device 10D is stored in the printing state memory M1. The ON/OFF state of the allowable value condition input switch SW4 in the input device 10D is stored in the allowable value condition memory M2. The reference density value (the reference density value of each color) with respect to the density measurement patch 9*a* of each color in the color bar 9-2 (FIG. 15) printed on a printing product is stored in the reference density value memory M3.

The first allowable density difference (the first allowable density difference of each color) with respect to the density measurement patch 9*a* of each color is stored in the first allowable density difference memory M4. The second allowable density difference (the second allowable density difference of each color) with respect to the patch 9*a* for each color is stored in the second allowable density difference memory M5. In this embodiment, the second allowable density difference of each color is set larger than the first allowable density difference.

A first allowable density ratio (first error ratio allowed with respect to the reference density value) β1 is stored in the first allowable density ratio memory M6. A second allowable density ratio (second error ratio allowed with respect to the reference density value) β2 is stored in the second allowable density ratio memory M7. In this embodiment, the second allowable density ratio β2 is set larger than the first allowable density ratio β1 (β2>β1).

The minimum value of a measured density difference for adjusting the ink supply amount is set as an allowable density difference minimum value in the allowable density difference minimum value memory M8. The measurement position of the patch 9*a* of each color is stored in the patch position memory M9. The color data of the patch 9*a* of each color, which is sampled by the calorimeter 10L, is stored in the patch color data memory M10. A density value (measured density value) obtained from the color data of the patch 9*a* of each color, which is sampled by the calorimeter 10L, is stored in the measured density value memory M11.

A conversion curve is stored in the conversion curve memory M12. The conversion curve represents the relationship between the difference between the measured density value and the reference density value of each color and the adjustment amount of the opening ratio of the ink key. The adjustment amount (reference correction amount) of the opening ratio of each ink key is stored in the ink key opening ratio reference correction amount memory M13. The adjustment amount is obtained from the conversion curve in the memory M12. A first coefficient (first control ratio) α1 is stored in the first coefficient memory M14. The first coefficient α1 is used to correct the reference correction amount of the opening ratio of each ink key. A second coefficient (second control ratio) α2 is stored in the second coefficient memory M15. The second coefficient α2 is used to correct the reference correction amount of the opening ratio of each ink key. In this embodiment, the first coefficient αl and second coefficient α2 are different from each other and are set to α1>α2.

The correction amount of the opening ratio of each ink key is stored in the ink key opening ratio correction amount memory M16. The correction amount is corrected by using the coefficient α1 or α2. The difference (measured density difference) between the measured density value of the patch 9*a* of each color and the reference density value of each color is stored in the measured density difference memory M17. Reference density value measured color information input by the operator is stored in the color information memory M18. The color data sampled by the reference density value measurement calorimeter 10T is stored in the color data memory M19.

Figure 3:
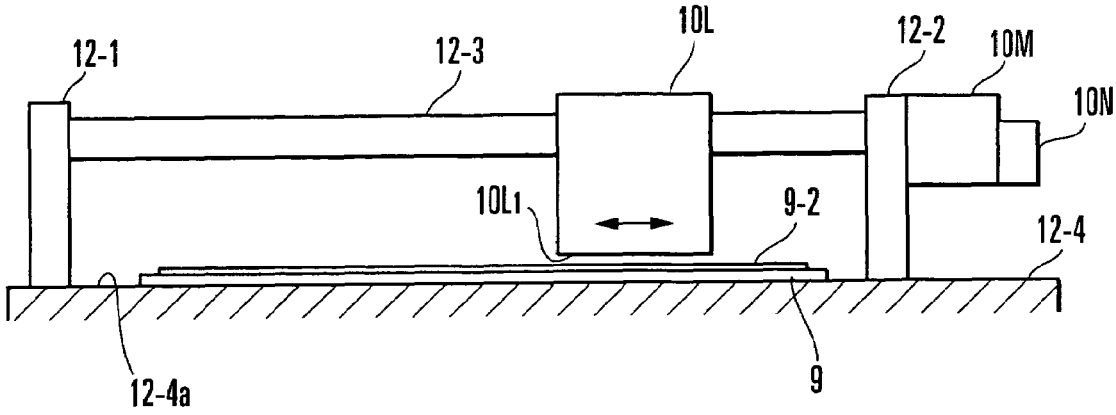
FIG. 3 is a side view of a colorimeter shown in FIG. 1.

As shown in FIG. 3, the colorimeter 10L is attached to a ball screw (feed screw) 12-3 arranged between a pair of columns 12-1 and 12-2. The ball screw 12-3 is rotated in the forward or reverse direction by the calorimeter moving motor 10M. As the ball screw 12-3 rotates in the forward or reverse direction, the calorimeter 10L moves between the columns 12-1 and 12-2 while being guided by the ball screw 12-3. A head portion 10$L_1$ of the calorimeter 10L is directed to a surface 12-4*a* of a measurement table 12-4 on which an object to be measured is placed.

The operation of the first embodiment will be described below with reference to FIGS. 5A to 5E, and FIG. 6.

[Color Matching Before Start of Final Printing (Color Matching at Time of Preparation for Printing)]

In color matching before the start of final printing, the operator sets, on the measurement table 12-4 (FIG. 3), the printing product 9 printed by the printing press as an object to be measured. In this state, the color bar 9-2 printed on the printing product 9 is located under the head portion 10$L_1$ of the calorimeter 10L.

Next, the operator instructs the start of the color matching operation through the input device 10D. Accordingly, the CPU 10A stores "0" in the memory M1 (step S101 shown in FIG. 5A). The CPU 10A also stores "0" in the memory M2 (step S102). When the operator inputs first and second allowable density ratios β1 and β2, the CPU 10A stores the first allowable density ratio β1 in the memory M6, and the also stores the second allowable density ratio β2 in the memory M7 (step S103). When the operator inputs the allowable density difference minimum value, the CPU 10A stores the input allowable density difference minimum value in the memory M8 (step S104). When the operator inputs the reference density value of each color in the color bar 9-2 from the input device 10D, the CPU 10A stores the reference density value of each color in the memory M3 (step S105). Note that the second allowable density ratio β2 is input as a value larger than the first allowable density ratio β1.

The operator inputs the position of each patch of each color in the color bar 9-2 from the input device 10D (step S106). On the basis of the position of the input patch of each color, the CPU 10A calculates the position of the patch of each color to be measured by the colorimeter 10L, i.e., the position (measurement position) of the density measurement patch 9*a* of each color. The calculated measurement position is stored in the memory M9 (step S107).

The operator inputs the first coefficient α1 and second coefficient α2 to correct the reference correction amount of the opening ratio of each ink key. The CPU 10A stores the input first coefficient α1 in the memory M14. The CPU 10A stores the second coefficient α2 in the memory M15 (step S108).

The operator turns on the start switch SW2 in the input device 10D. On the basis of the step ("YES" in step S122), the CPU 10A reads out the reference density value of each color from the memory M3 (step S130), and then reads out the first allowable density ratio β1 from the memory M6 (step S131). Accordingly, the CPU 10A calculates the first allowable density difference of each color from the readout reference density value and first allowable density ratio β1 of each color. The resultant difference is stored in the memory M4 (step S132). In this calculation, the CPU 10A obtains the first allowable density difference of each color by multiplying the reference density value of each color by the first allowable density ratio β1 commonly used for each color.

The CPU 10A reads out the second allowable density ratio β2 from the memory M7 (step S133). The CPU 10A also calculates the second allowable density difference of each color from the reference density value of each color readout in step S130 and the second allowable density ratio β2 read out in step S133. The resultant value is stored in the memory M5 (step S134). In this calculation, the CPU 10A obtains the second allowable density difference of each color by multiplying the reference density value of each color by the second allowable density ratio β2 commonly used for each color.

The CPU 10A then reads out the allowable density difference minimum value from the memory M8 (step S135), and compares the readout allowable density difference minimum value with the first allowable density difference of each color obtained in step S132 (step S136). If the first allowable density difference is smaller than the allowable density difference minimum value ("YES" in step S136), the first allowable density difference of the corresponding color is changed to the allowable density difference minimum value (step S137). In a similar way, the CPU 10A compares the allowable density difference minimum value with the second allowable density difference of each color obtained in step S134 (step S138). If the second allowable density difference is smaller than the allowable density difference minimum value, the second allowable density difference of the corresponding color is changed to the allowable density difference minimum value (step S139).

Figure 4:
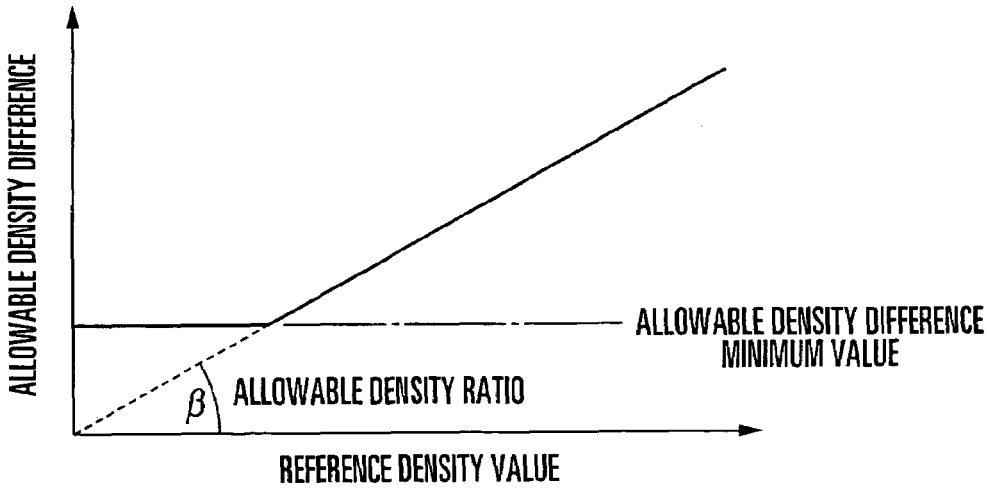
FIG. 4 is a graph showing a relationship between a reference density value and an allowable density difference set in accordance with the reference density value in the ink supply amount adjustment apparatus shown in FIG. 1.

Accordingly, as shown in FIG. 4, the proportionality constant of the allowable density difference (first and second allowable density differences) of each color is the allowable density ratio β (β1 and β2) commonly used for each color. The allowance density difference of each color is defined as the value corresponding to the reference density value of each color. The lower limit of the allowable density difference of each color is controlled to be set equal to or larger than the allowable density difference minimum value. With this control, the allowable density difference is prevented from being set excessively small.

As the allowable density ratio β (β1 and β2) commonly used for each color is set, the allowable density difference (first and second allowable density differences) of each color can be automatically set as the adequate value corresponding to the reference density value of each color. Hence, not only when using the ink which is generally used, but also when using the special ink which has never (rarely) been used, the adequate value of the allowable density difference can be obtained. That is, the adequate value of the allowable density difference corresponding to the reference density value of the ink can be automatically set only by applying the reference density value of the special ink. Therefore, the present invention can solve the problems that the ink supply amount is not corrected although it must be corrected, and that the ink supply amount is corrected although it need not be corrected, thereby causing the hunting phenomenon of the ink thickness on the paper sheet.

Figure 5A:
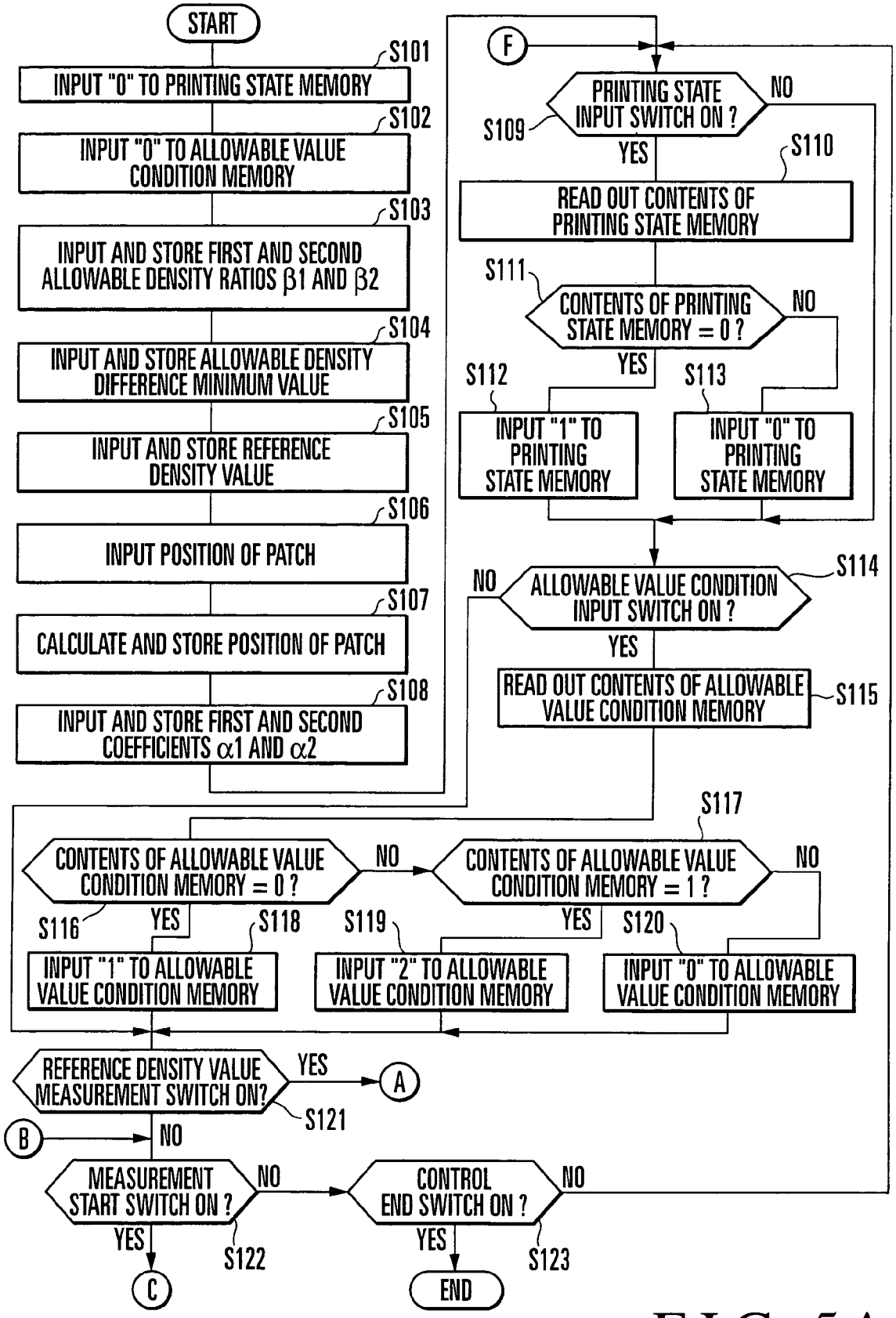
FIGS. 5A to 5E are flowcharts showing the processing operation of the ink supply amount adjustment apparatus shown in FIG. 1.

Note that in this embodiment, when the reference density value of the ink is unknown, the reference density value measurement calorimeter 10T is set to the printing product (the printing product printed by the reference density value) printed by the ink. The switch SW5 instructing to measure the reference density value is turned on before turning on the start switch SW2 in step S122 (FIG. 5A).

As the switch SW5 is turned on ("YES" in step S121), the CPU 10A urges the operator to input the reference density value measured color information. Accordingly, when the operator inputs the color of the ink on this printing product as the reference density value measured color information in response to the CPU 10A ("YES" in step S124 shown in FIG. 5E), the CPU 10A stores the input reference density value measured color information in the memory M18 (step S125) to supply a measurement start signal to the calorimeter 10T (step S126). Next, the color data is read out from the colorimeter 10T, and the readout color data is stored in the memory M19 (step S127).

The CPU 10A then calculates the density value of the ink printed on the printing product from the input reference density value measured color information and the color data from the calorimeter 10T (step S128). The calculation result is stored in the memory M3 as the reference density value of the color of the ink (step S129).

Figure 5B:
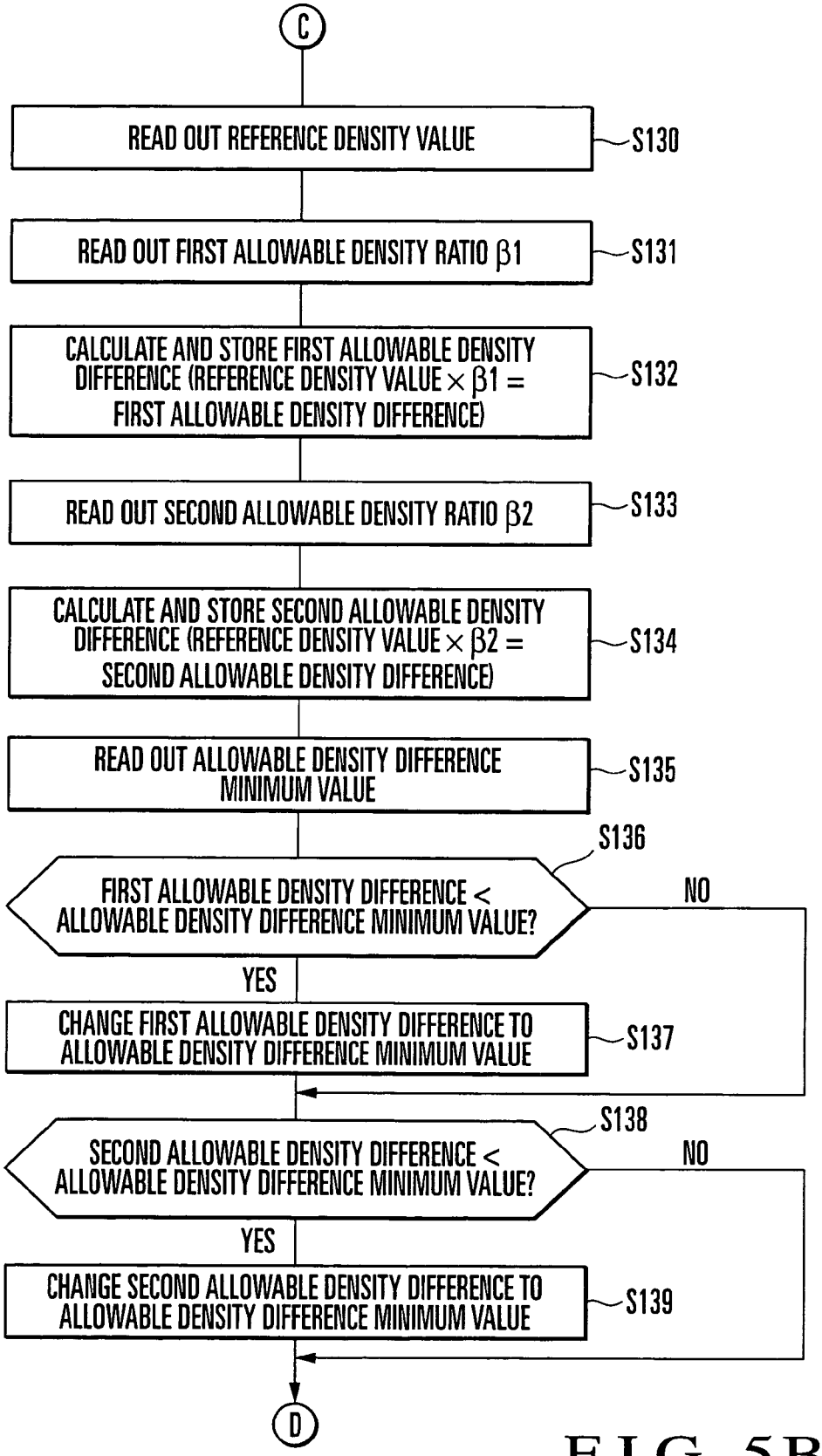
Figure 5C:
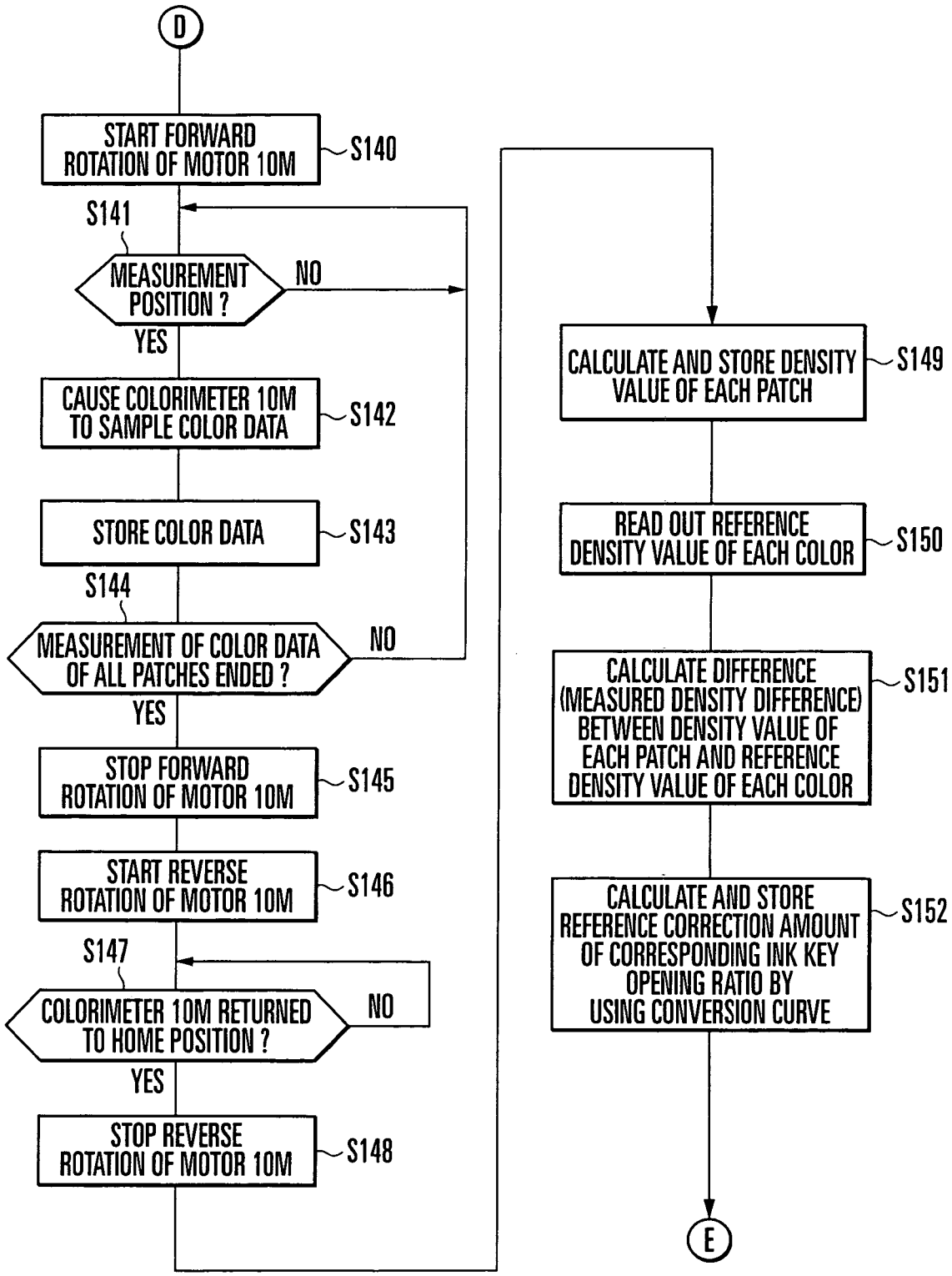

After steps S130 to S139, the CPU 10A rotates the motor 10M in the forward direction (step S140 shown in FIG. 5C). As the motor 10M rotates in the forward direction, the ball screw 12-3 rotates in the forward direction. The calorimeter 10L is guided by the ball screw 12-3 and moves from the home position in contact with the column 12-1 toward the column 12-2.

After step S108, the CPU 10A repeats the loop of step S109→S114→S121→S122→S123. Accordingly, the states of the switches SW1 to SW5 are monitored. In this case, since the density measurement start switch SW2 is turned on in step S122, the flow advances to step S140 through steps S130 to S139 to move the calorimeter 10L.

The CPU 10A monitors every moving position of the colorimeter 10L through the rotary encoder 10N (step S141). When the colorimeter 10L has reached the first measurement position stored in the memory M9, the color data of the patch 9*a* located at that measurement position is sampled by the calorimeter 10L (step S142). The CPU 10A stores the color data (calorimetric data) from the calorimeter 10L in the memory M10 (step S143).

In a similar way, every time reaching the measurement position stored in the memory M9, the CPU 10A causes the colorimeter 10L to sample the color data of the patch 9*a* located at that measurement position and stores the sampled color data in the memory M10. As described above, the CPU 10A executes automatic scanning control of the calorimeter 10L to sequentially sample the color data of the density measurement patch 9*a* of each patch in the color bar 9-2 printed on the printing product 9.

When the CPU 10A determines that the color data sampling of all patches 9*a* of the color bar 9-2 is ended ("YES" in step S144), the forward rotation of the motor 10M is stopped (step S145). Next, the CPU 10A rotates the motor 10M in the reverse direction (step S146). When the CPU 10A checks that the calorimeter 10L returns to the home position (step S147), the reverse rotation of the motor 10L is stopped (step S148).

The CPU 10A calculates the density value of the patch 9*a* of each color from the calorimetric data of the patch 9*a* of each color stored in the memory M10 and stores the density value in the memory M11 (step S149). In this embodiment, as the calorimeter 10L, a spectrometer is used. The output value of each wavelength from the spectrometer is multiplied by the transmittance of each wavelength of the filter to be used to measure the solid patch of each color by a densitometer. The calculated values are totalized to obtain the density value of each color.

The CPU 10A reads out the reference density value of each color from the memory M3 (step S150). The density difference (measured density difference) and the measured density value of the patch 9*a* of each color stored in the memory M11 is calculated (step S151). The CPU 10A obtains the adjustment amount of the opening ratio of an ink key corresponding to the measured density difference of the patch 9*a* of each color by using a conversion table (representing the relationship between the measured density difference of each color and the adjustment amount of the ink key opening ratio) stored in the memory M12. The resultant adjustment amount (reference correction amount) is stored in the memory M13 (step S152).

Figure 5D:
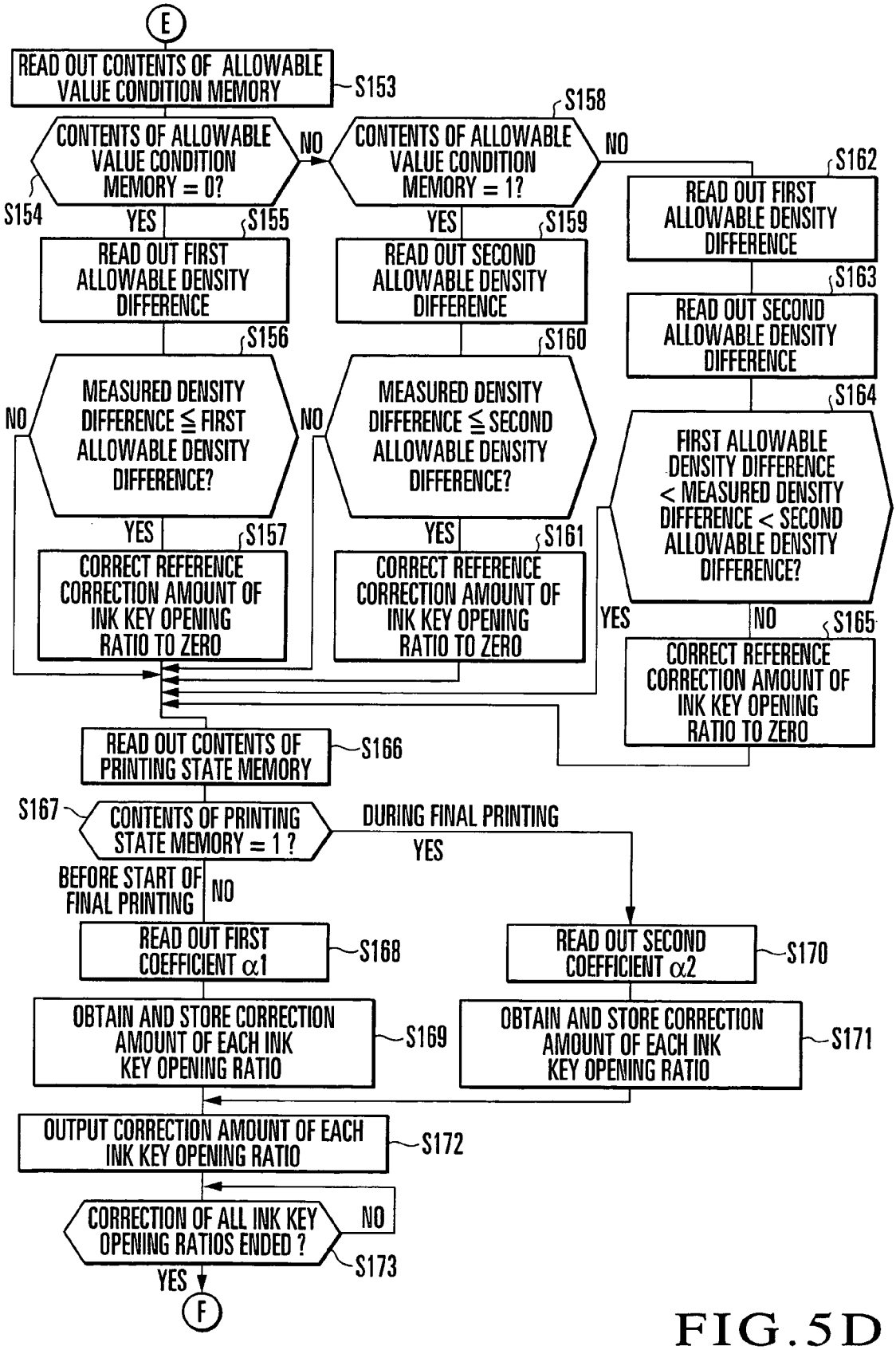
Figure 5E:
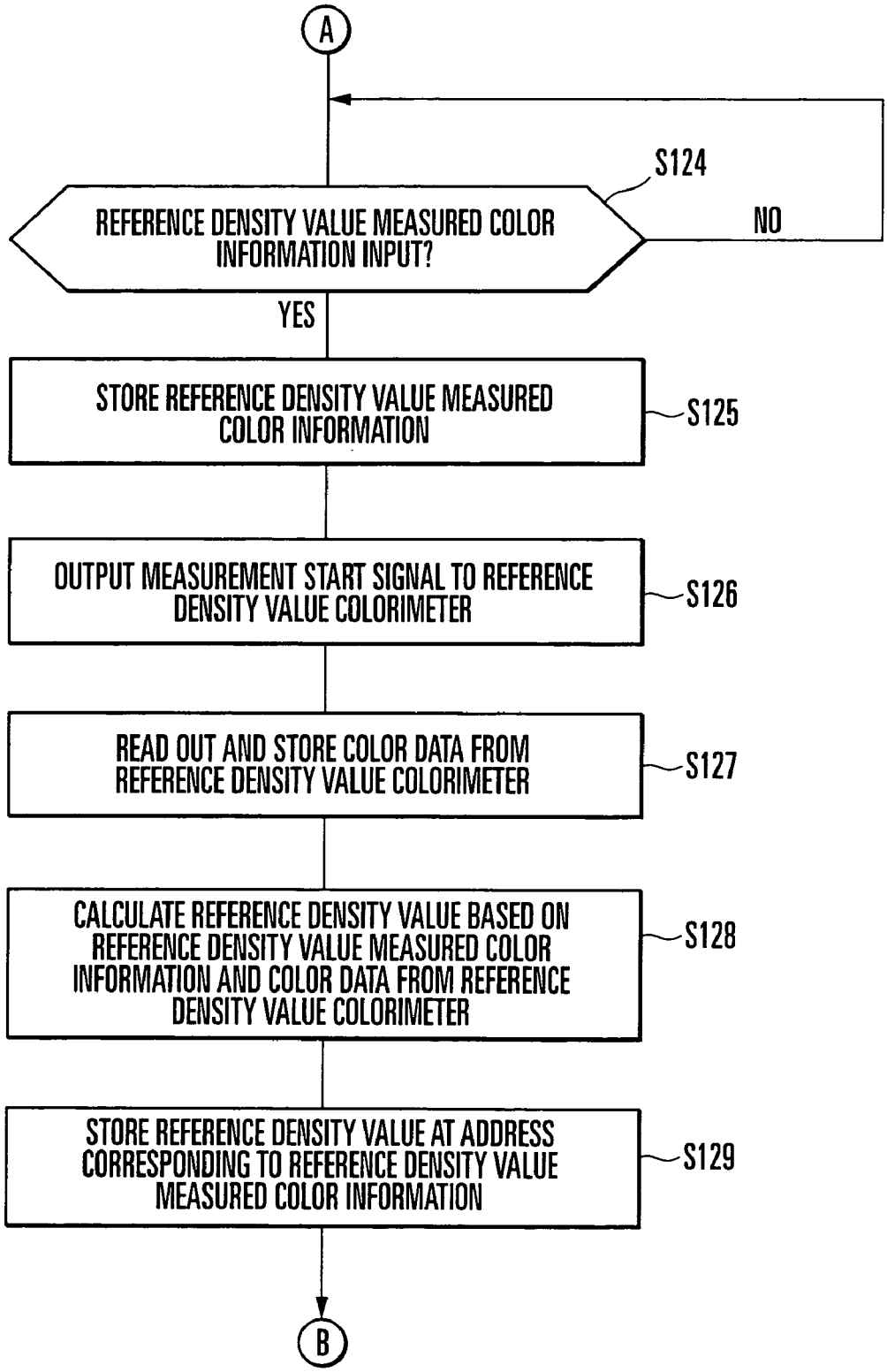

Next, the CPU 10A reads out the contents of the memory M2 (step S153 shown in FIG. 5D). When "0" is stored in the memory M2 ("YES" in step S154), the CPU 10A determines that the first allowable density difference should be used as the allowable density difference for color matching. The flow advances to step S155. When "0" is not stored in the memory M2 ("NO" in step S154), the CPU 10A determines that the first allowable density difference should not be used as the allowable density difference for color matching. The flow advances to step S158. In this embodiment, "0" has been stored in the memory M2 in step S102. Hence, the flow advances to step S155.

In step S155, the CPU 10A reads out the first allowable density difference of each color from the memory M4. The CPU 10A compares the measured density difference of the patch 9*a* of each color, which is calculated in step S151, with the readout first allowable density difference of each color, (step S156). For a patch whose measured density difference is determined to be equal to or smaller than the first allowable density difference ("YES" in step S156), the reference correction amount of the opening ratio of the ink key corresponding to this patch is set to zero (step S157). Accordingly, the reference correction amount of the opening ratio of the corresponding ink key is set to a value other than zero only when the measured density difference is larger than the first allowable density difference. Only for this ink key, the opening ratio is adjusted (the ink supply amount is adjusted), as will be described later.

The CPU 10A reads out the contents stored in the memory M1 (step S166). If "0" is stored in the memory M1 ("NO" in step S167), the CPU 10A determines that it is color matching before the start of final printing. If "1" is stored in the memory M1 ("YES" in step S167), the CPU 10A determines that it is color matching during final printing. In this embodiment, "0" has been stored in the memory M1 in step S101. Hence, the CPU 10A determines that it is color matching before the start of final printing. The flow advances to step S168.

In step S168, the CPU 10A reads out the first coefficient $\alpha 1$ from the memory M14. The reference correction amount of the opening ratio of each ink key is multiplied by the readout first coefficient $\alpha 1$ to obtain the correction amount of the opening ratio of each ink key. The resultant correction amount is stored in the memory M16 (step S169). The resultant correction amounts of the opening ratios of the ink keys are output to the motor drivers 11A in the motor control devices 11-1 to 11-n (step S172).

In each of the motor control devices 11-1 to 11-n, upon receiving the correction amount of the opening ratio of a corresponding ink key ("YES" in step S201 shown in FIG. 6), the received correction amount is read (step S202). In addition, the current ink key opening ratio is read through the counter 11D (step S203). A corrected ink key opening ratio is calculated on the basis of the correction amount of the ink key opening ratio from the CPU 10A and the current ink key opening ratio (step S204).

If the corrected ink key opening ratio equals the current ink key opening ratio ("YES" in step S205), the ink key opening ratio correction end signal is output to the ink supply amount adjustment apparatus 10 (step S210). If the corrected ink key opening ratio does not equal the current ink key opening ratio ("NO" in step S205), the motor 11B is driven until the corrected ink key opening ratio equals the current ink key opening ratio (steps S206 to S209). After that, the ink key opening ratio correction end signal is output to the ink supply amount adjustment apparatus 10 (step S210).

Upon receiving the ink key opening ratio correction end signals from all the motor control devices 11 ("YES" in step S173 shown in FIG. 6A), the CPU 10A of the ink supply amount adjustment apparatus 10 returns to step S109 (FIG. 5A) to repeat the loop of step S109→S114→S121→S122→S123. In this loop, if the switch SW3 is turned on ("YES" in step S123), the above-described processing of color matching before the start of final printing is ended. Alternatively, if the switch SW2 is determined to be turned on ("YES" in step S122), the above-described processing of color matching before the start of final printing is repeated again.

[Change of Allowable Density Difference: When Hunting Phenomenon May Occur]

The operator repeats the above-described color matching before the start of final printing until the density difference between the measured density value of each color and the reference density value of each color becomes equal to or smaller than the first allowable density difference in all the regions S1 to Sn on the printing product 9. More specifically, printing is continued for a while until the effect of adjustment of the ink supply amount appears. A new printing product 9 is sampled, and color matching is executed again. This operation is repeated.

The operator checks the result of the preceding color matching. If he/she suspects that the hunting phenomenon of the ink thickness on the paper sheet should occur, the allowable density difference is changed from the first allowable density difference to the second allowable density difference. From the next color matching, the ink supply amount is adjusted only when the measured density difference is larger than the second allowable density difference (>first allowable density difference). That is, the threshold value for adjustment of the ink supply amount is made large. Accordingly, the hunting phenomenon of the ink thickness on the paper sheet can be suppressed.

The allowable density difference is changed by operating the switch SW4. In this embodiment, the switch SW4 is turned on only when it is pressed and immediately returns to the OFF state. When the switch SW4 is turned on (step S114 shown in FIG. 5A), the CPU 10A reads out the contents of the memory M2 (step S115).

If "0" is stored in the memory M2 ("YES" in step S116), the CPU 10A changes the contents of the memory M2 to "1" (step S118). If "0" is not stored in the memory M2 ("NO" in step S116), the flow advances to step S117. In this embodiment, "0" has been stored in the memory M2 in step S102. Hence, the flow advances to step S118 to change the contents of the memory M2 to "1".

In this way, the switch SW4 is turned on once to change the contents of the memory M2 to "1". Then, the operator turns on the switch SW2. When the switch SW2 is turned on ("YES" in step S122), the CPU 10A executes the processing in steps S130 to S152 (FIGS. 5B and 5C).

After step S152, the CPU 10A reads out the contents of the memory M2 (step S153 shown in FIG. 5D). Since "1" is stored in the memory M2, the flow advances to step S159 through "NO" in step S154, and "YES" in step S158. The CPU 10A reads out the second allowable density difference of each color from the memory M5. The CPU 10A compares the measured density difference of the patch 9*a* of each color, which is calculated in step S151, with the second allowable density difference of each color (step S160). For a patch whose measured density difference is equal to or smaller than the second allowable density difference ("YES" in step S160), the adjustment amount (reference correction amount) of the opening ratio of the corresponding ink key corresponding to this patch is set to zero (step S161). Accordingly, the reference correction amount of the opening ratio of the corresponding ink key is set to a value other than zero only when the measured density difference is larger than the second allowable density difference. Only for this ink key, the opening ratio is adjusted (the ink supply amount is adjusted).

[Change of Allowable Density Difference: When Unexpected Accident has Occurred]

When an unexpected accident such as paper fold error, paper breakage, or smear on the printing product has occurred, and the density value of a specific part of the printing product 9 has temporarily largely varied, the operator changes the allowable density difference range from a range equal to or smaller than the first allowable density difference to a range from the second allowable density difference to the first allowable density difference (both inclusive). Accordingly, from the next color matching, the ink supply amount is adjusted only when the measured density difference is larger than the first allowable density difference and smaller than the second allowable density difference. In this case, even when the measured density difference exceeds the second allowable density value, the ink supply amount is not adjusted. The amount of wasted paper generated by the temporary variation in density value can be decreased.

The allowable density difference is changed by operating the switch SW4. When the switch SW4 is turned on (first time), the CPU 10A stores "1" in the memory M2 (step S114→S115→S116→S118). When the switch SW4 is turned on again (second time), the CPU 10A stores "2" in the memory M2 (step S114→S115→S116→S117→S119).

In this way, the switch SW4 is turned on twice to store "2" in the memory M2. Then, the operator turns on the switch SW2. When the switch SW2 is turned on ("YES" in step S122), the CPU 10A executes the processing in steps S130 to S152 (FIGS. 5B and 5C).

After step S152, the CPU 10A reads out the contents of the memory M2 (step S153 shown in FIG. 5D). Since "2" is stored in the memory M2, the CPU 10A reads out the first and second allowable density differences of respective colors from the memories M4 and M5 through "NO" in steps S154 and S158 (steps S162 and S163). The CPU 10A compares the measured density difference of the patch 9*a* of each color, which is calculated in step S151, with the first and second allowable density differences of respective colors (step S164). For a patch whose measured density difference is equal to or smaller than the first allowable density difference or equal to or larger than the second allowable density difference ("NO" in step S164), the reference correction amount of the opening ratio of the ink key corresponding to this patch is set to zero (step S165). Accordingly, the reference correction amount of the opening ratio of the corresponding ink key is set to a value other than zero only when the measured density difference is larger than the first allowable density difference and smaller than the second allowable density difference. Only for this ink key, the opening ratio is adjusted (the ink supply amount is adjusted).

[Color Matching During Final Printing]

To execute color matching during final printing, the operator turns on the switch SW1. In this embodiment, the switch SW1 is turned on only when it is pressed and immediately returns to the OFF state. When the switch SW1 is turned on (step S109 shown in FIG. 5A), the CPU 10A reads out the contents of the memory M1 (step S110).

If "0" is stored in the memory M1 ("YES" in step S111), the CPU 10A changes the contents of the memory M1 to "1" (step S112). Alternatively, if "1" is stored in the memory M1 ("NO" in step S111), the CPU 10A changes the contents of the memory M1 to "0" (step S113). In this case, "0" has been stored in the memory M1 in step S101. Hence, the contents of the memory M1 is changed to "1" (step S112).

Next, the operator turns on the start switch SW2. When the switch SW2 is turned on ("YES" in step S122), the CPU 10A executes the processing in steps S130 to S152 (FIGS. 5B and 5C).

After step S152, the CPU 10A reads out the contents of the memory M2 (step S153 shown in FIG. 5C). When "0" is stored in the memory M2, the CPU 10A executes the processing in steps S155 to S157. When "1" is stored in the memory M2, the CPU 10A executes the processing in steps S159 to S161. When "2" is stored in the memory M2, the CPU 10A executes the processing in steps S162 to S165.

The CPU 10A reads out the contents of the memory M1 (step S166). If "0" is stored in the memory M1 ("NO" in step S167), the CPU 10A determines that it is color matching before the start of final printing. If "1" is stored in the memory M1 ("YES" in step S167), the CPU 10A determines that it is color matching during final printing. In this case, "1" has been stored in the memory M1 in step S112. Hence, the CPU 10A determines that it is color matching during final printing, and the flow advances to step S170.

In step S170, the CPU 10A reads out the second coefficient $\alpha 2$ from the memory M15. The reference correction amount of the opening ratio of each ink key is multiplied by the readout second coefficient $\alpha 2$ to obtain the correction amount of the opening ratio of each ink key. The resultant correction amount is stored in the memory M16 (step S171). The resultant correction amounts of the opening ratios of the ink keys are output to the motor drivers 11A in the motor control devices 11-1 to 11-n (step S172).

Upon receiving the ink key opening ratio correction end signals from all the motor control devices 11-1 to 11-n ("YES" in step S173), the loop of step S109→S114→S121→S122→S123 is repeated. In this loop, if the switch SW3 is turned on ("YES" in step S123), the above-described processing of color matching during final printing is ended. Alternatively, if the switch SW2 is turned on ("YES" in step S122), the above-described processing of color matching during final printing is repeated again.

Second Embodiment

In the first embodiment, the first and second allowable density ratios $\beta 1$ and $\beta 2$ used in color matching before the start of final printing are the same as those used for color matching during final printing. In color matching before the start of final printing, the ink amount in the inker is often largely different from the ink amount necessary for a printing product to be printed. Hence, the measured density difference is large. To the contrary, in color matching during final printing, the ink amount in the inker is not so different from the ink amount necessary for a printing product to be printed. Hence, the measured density difference is small. In the second embodiment, the first and second allowable density ratios $\beta 1F$ and $\beta 2F$ for color matching before the start of final printing and the first and second allowable density ratios $\beta 1M$ and $\beta 2M$ for color matching during final printing are set. The first and second allowable density ratios (during final printing) β1M and β2M are set smaller than the first and second allowable density ratios (before the start of final printing) β1F and β2F.

An ink supply amount adjustment apparatus according to the second embodiment of the present invention will be described with reference to FIG. 7. The same reference numerals as in FIG. 11 denote the same or similar constituent elements in FIG. 1, and a description thereof will be omitted. In this embodiment, an input device 10D further comprises an allowable value condition input switch SW41 for color matching before the start of final printing and an allowable value condition input switch SW42 for color matching during final printing.

As shown in FIG. 12, the memory unit M also comprises an allowable value condition memory M21 for color matching before the start of final printing and an allowable value condition memory M22 for color matching during final printing as allowable value condition memories. The apparatus also comprises memories M41 and M42 as first allowable density difference memories for each color. The memory M41 stores the first allowable density difference of each color for color matching before the start of final printing. The memory M42 stores the first allowable density difference of each color for color matching during final printing. The apparatus also comprises memories M51 and M52 as second allowable density difference memories for each color. The memory M51 stores the second allowable density difference of each color for color matching before the start of final printing. The memory M52 stores the second allowable density difference of each color for color matching during final printing.

In FIGS. 9A to 9F, the processing operation executed by a CPU 10A of an ink supply amount adjustment apparatus 10. The same step numbers as in FIGS. 5A, 5B, and 5D denote the same processing contents in FIGS. 9A to 9F, and a description thereof will be omitted. Note that, in the second embodiment, FIGS. 5C (steps S140 to S152) and 5E (steps S124 to 129) in the first embodiment are applied. Therefore, after step S139*b* shown in FIG. 9D, the flow advances to step S140 shown in FIG. 5C. After step S152 shown in FIG. 5C, the flow advances to step S153 shown in FIG. 5C. If "YES" in step S121 shown in FIG. 9B, the flow advances to step S124 shown in FIG. 5E. After step S129 shown in FIG. 5E, the flow advances to step S122 shown in FIG. 9B.

Figure 9A:
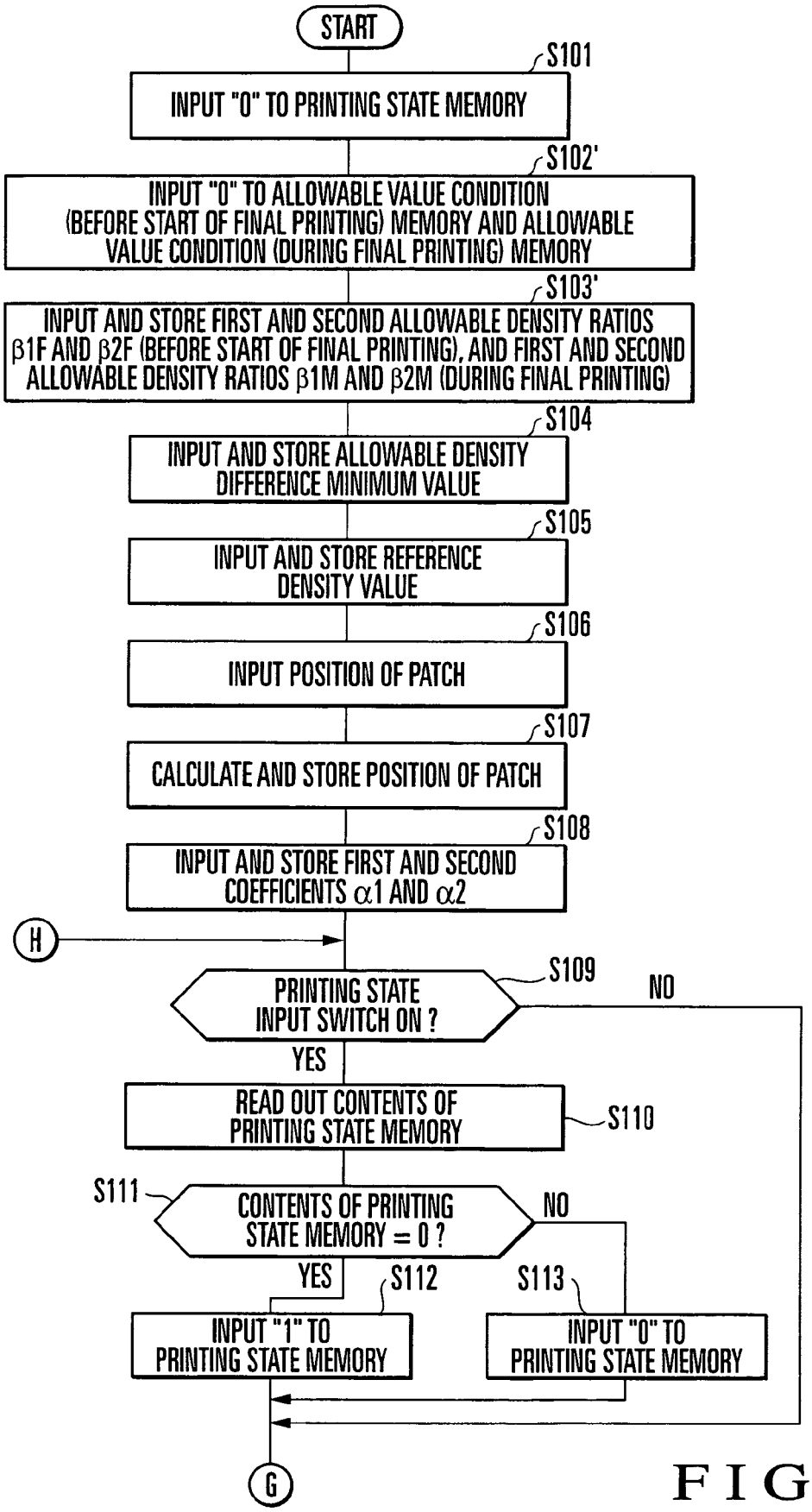
FIGS. 9A to 9F are flowcharts showing the processing operation of the ink supply amount adjustment apparatus shown in FIG. 7.
Figure 9B:
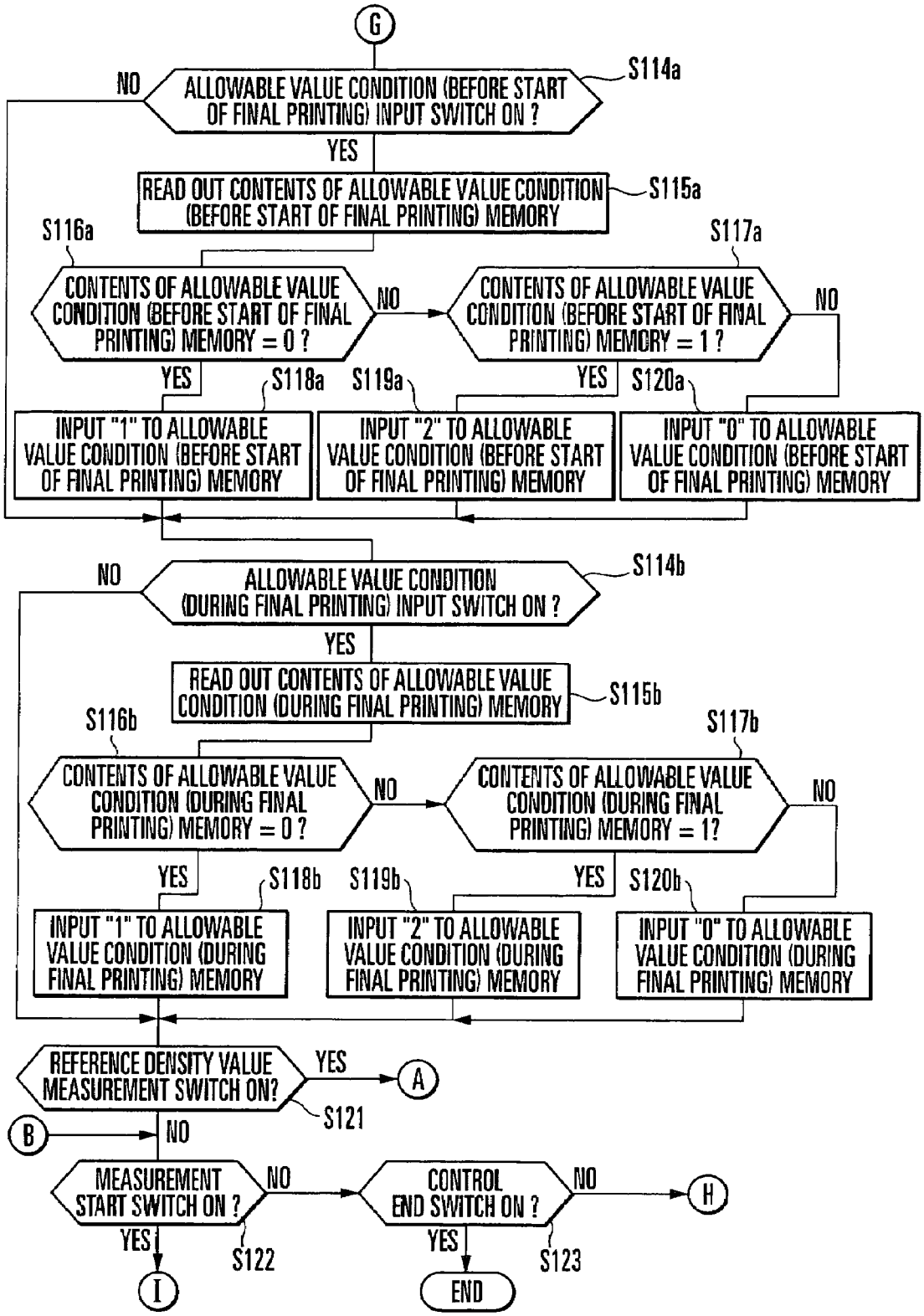

In the second embodiment, in step S103' shown in FIG. 9A, the operator inputs the first and second allowable density ratios (before the start of final printing) β1F and β2F, and the first and second allowable density ratios (during final printing) β1M and β2M. In this case, the first and second allowable density ratios (during final printing) β1M and β2M are input as values smaller than those (before the start of final printing) β1F and β2F. The input first and second allowable density ratios (before the start of final printing) β1F and β2F are stored in the memories M61 and M71, respectively. The input first and second allowable density ratios (during final printing) β1M and β2M are stored in the memories M62 and M72, respectively.

[Change of Allowable Density Difference for Color Matching Before Start of Final Printing]

First, "0" is stored in the allowable value condition memory (before the start of final printing) M21. In step S114*a* (FIG. 9B), when the switch SW41 is turned on once, "1" is stored in the allowable value condition memory (before the start of final printing) M21 (step S114*a*→S115*a*→S116*a*→S118*a*). When the switch SW41 is turned on twice, "2" is stored in the allowable value condition (before the start of final printing) memory M21 (step S114*a*→S115*a*→S116*a*→S117*a*→S119*a*).

When a switch SW2 is turned on ("YES" in step S122), CPU 10A reads out the reference density value of each color from the memory M3 (step S130 shown in FIG. 9C), and the first allowable density ratio (before the start of final printing) β1F from the memory M61 (step S131*a*). The CPU 10A calculates the first allowable density difference (before the start of final printing) of each color from the readout reference density value of each color and the first allowable density ratio (before the start of final printing) β1F. The calculation result is stored in the memory M41 (step S132*a*).

Next, the CPU 10A reads out the second allowable density ratio (before the start of final printing) β2F from the memory M71 (step S133*a*). The CPU 10A calculates the second allowable density difference (before the start of final printing) from the readout reference density value of each color and the second allowable density ratio (before the start of final printing) β2F. The calculation result is stored in the memory M51 (step S134*a*).

In a similar way, the CPU 10A reads out the first allowable density ratio (during final printing) β1M from the memory M62 (step S131*b*), and the second allowable density ratio (during final printing) β2M from the memory M72 (step S133*b*). The CPU 10A then calculates the first and second allowable density differences (during final printing) of each color (steps S132*b* and S134*b*). The calculation results are respectively stored in the memories M42 and M52.

The CPU 10A then reads out the allowable density difference minimum value from the memory M8 (step S135 shown in FIG. 9D), and compares the readout allowable density difference minimum value with the first allowable density difference (before the start of final printing) calculated in step S132*a* (step S136*a*). If the first allowable density difference (before the start of final printing) is smaller than the allowable density difference minimum value ("YES" in step S136*a*), the CPU 10A changes the first allowable density difference (before the start of final printing) of the corresponding color to the allowable density difference minimum value (step S137*a*). Next, the CPU 10A compares the second allowable density difference (before the start of final printing) calculated in step S134*a* with the allowable density difference minimum value. If the second allowable density difference (before the start of final printing) is smaller than the allowable density difference minimum value ("YES" in step S138*a*), the CPU 10A changes the second allowable density difference (before the start of final printing) of corresponding color to the allowable density difference minimum value (step S139*a*).

Similarly, the CPU 10A compares the first allowable density difference (during final printing) of each color calculated in step S132*b* with the allowable density difference minimum value (step S136*b*). If the first allowable density difference (during finial printing) is smaller than the allowable density difference minimum value ("YES" in step S136*b*), the CPU 10A changes the first allowable density difference (during final printing) of corresponding color to the allowable density difference minimum value (step S137*b*). Then, the CPU 10A compares the second allowable density difference (during final printing) of each color calculated in step S134*b* with the allowable density difference minimum value (step S138*b*). If the second allowable density difference (during final printing) is smaller than the allowable density difference minimum value ("YES" in step S138*b*), the CPU 10A changes the second allowable density difference (during final printing) of corresponding color to the allowable density difference minimum value (step S139*b*).

Figure 9C:
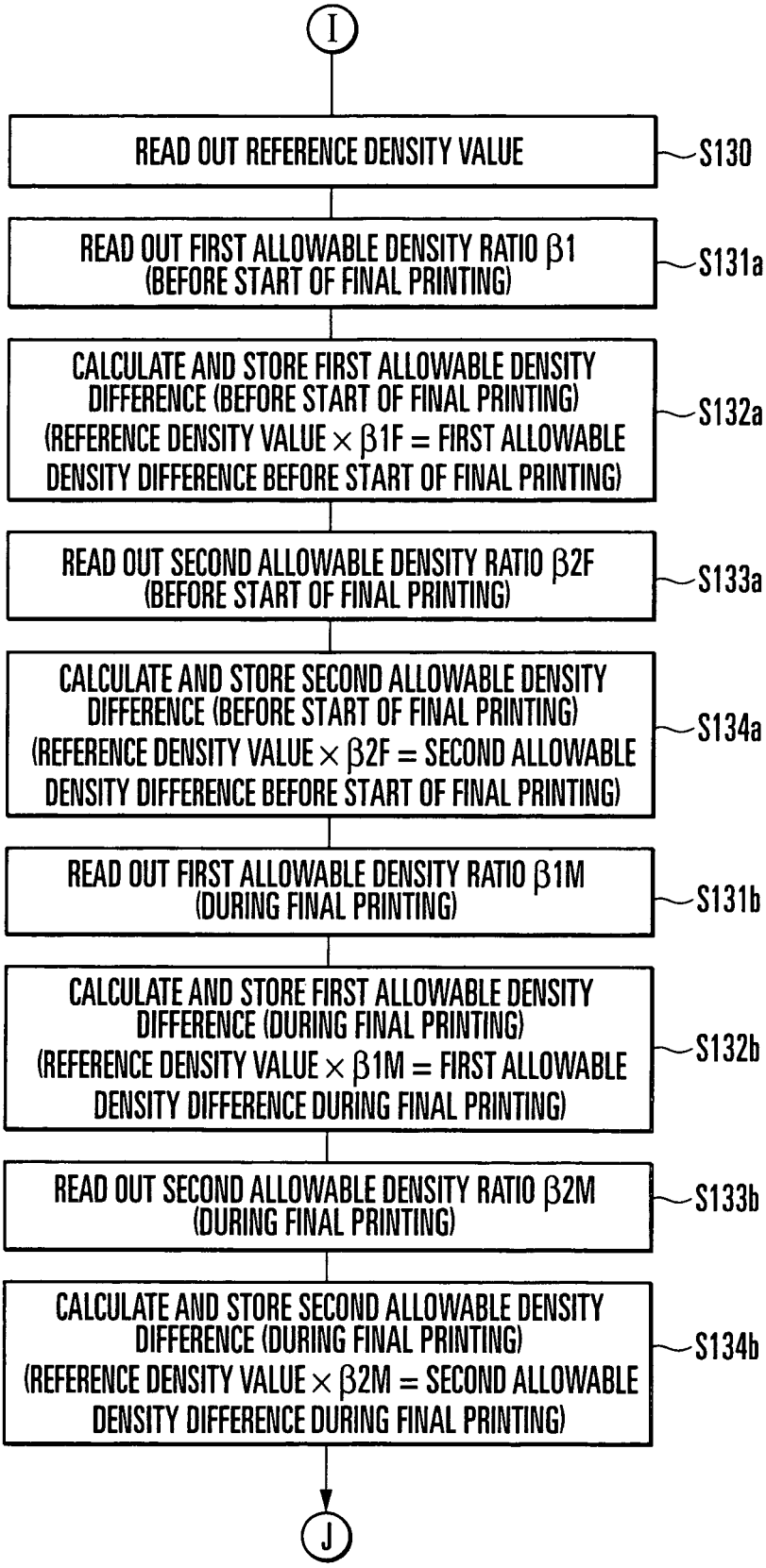
Figure 9D:
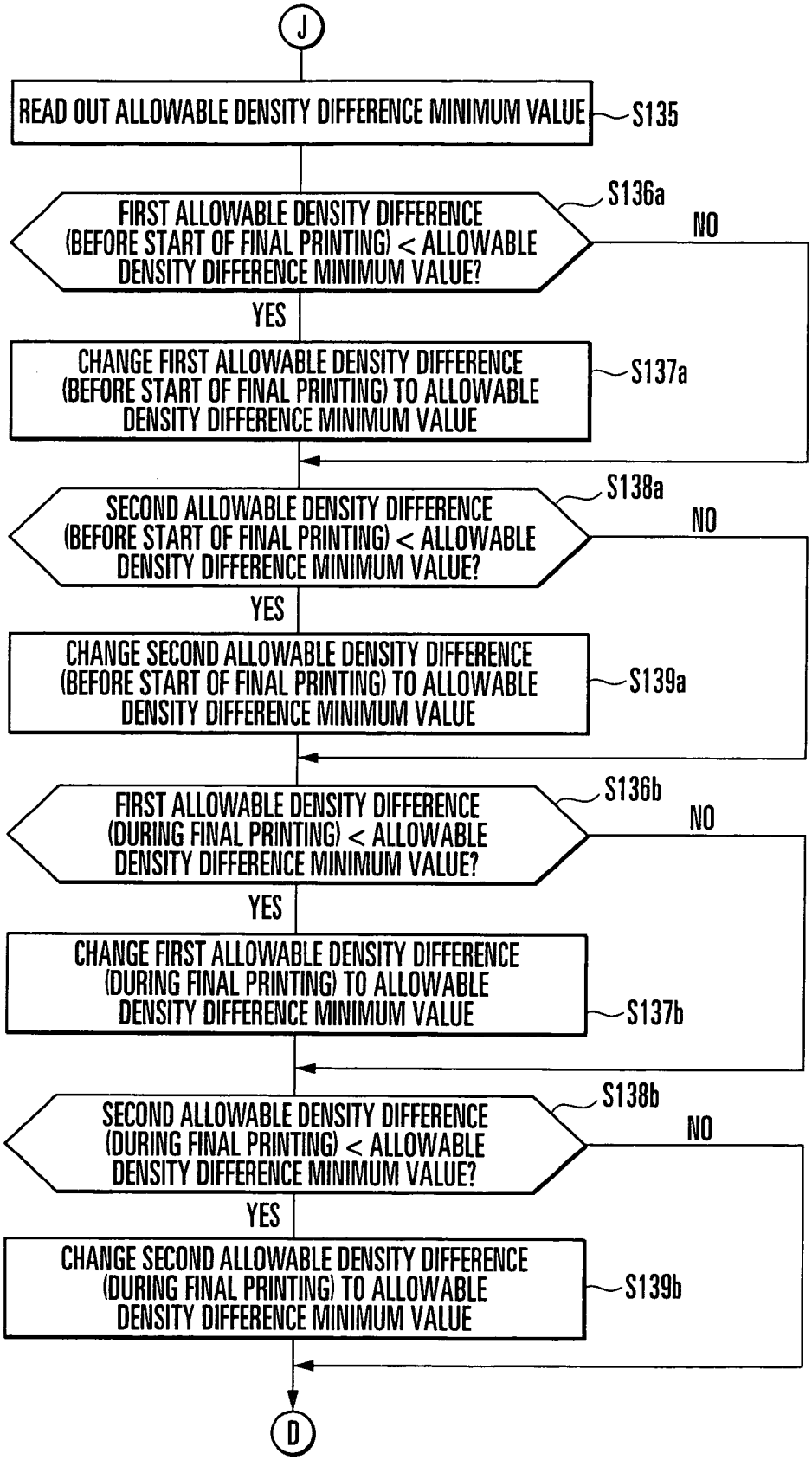
Figure 9E:
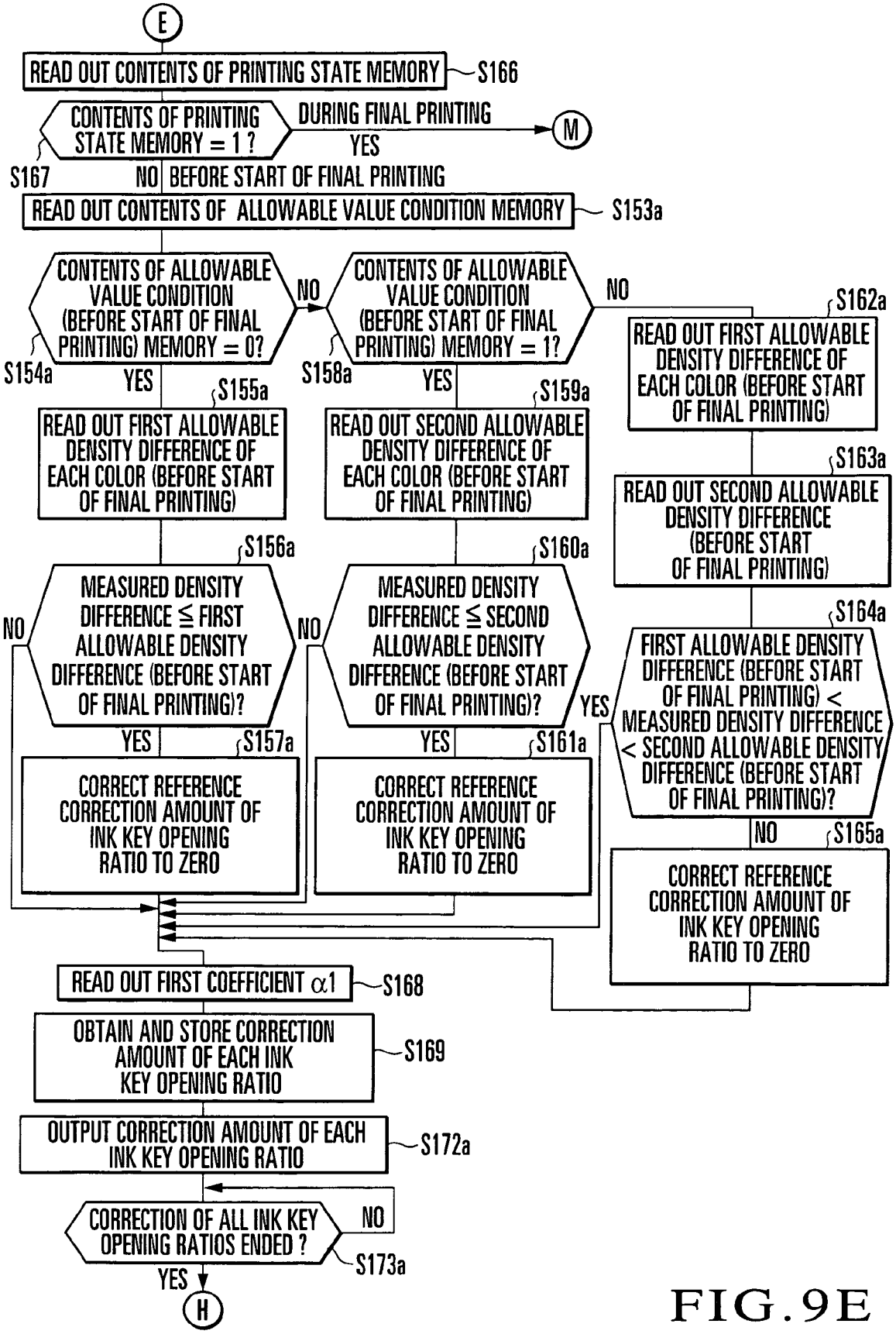
Figure 9F:
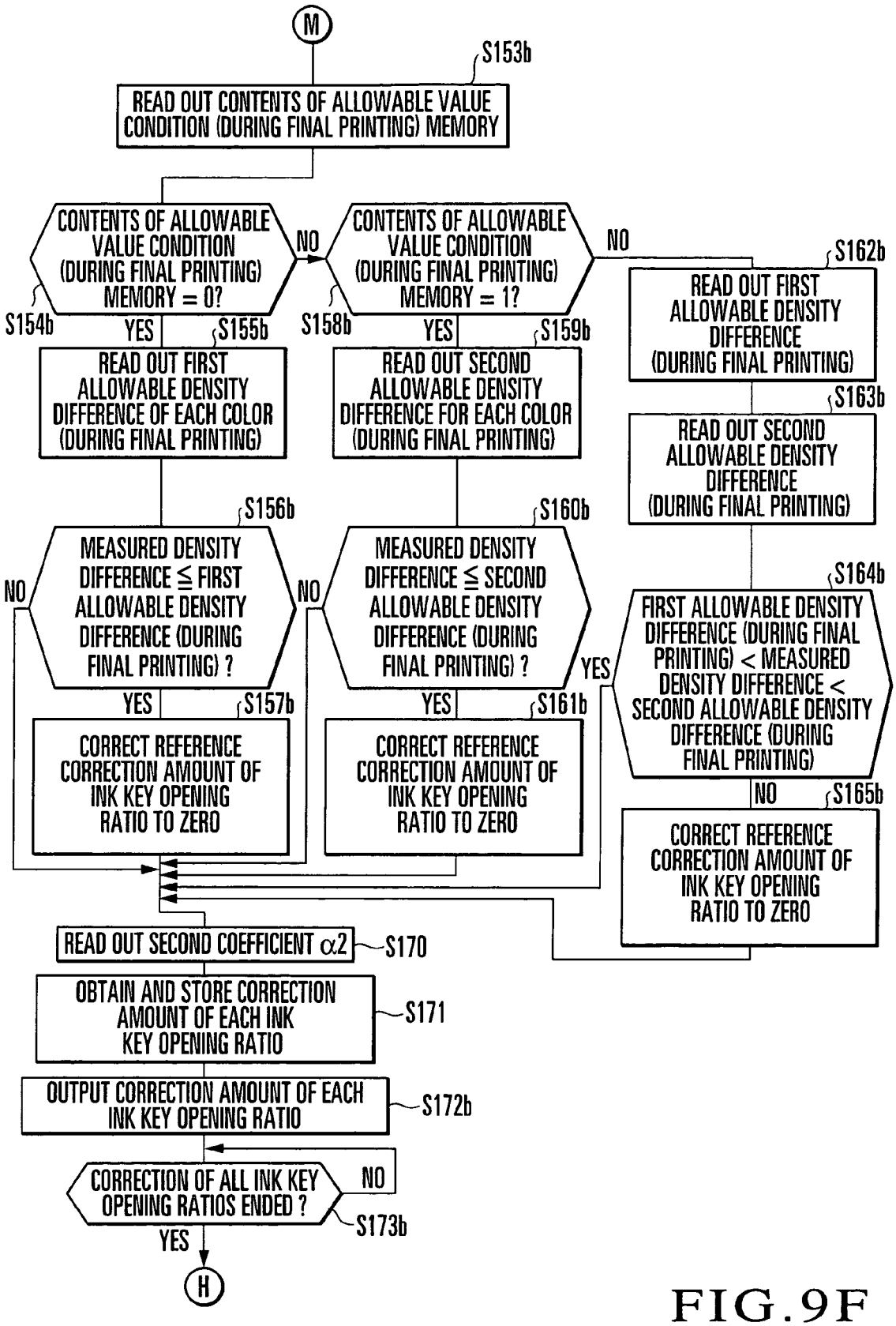

The CPU 10A executes the processing in steps S140 to S152 (FIG. 5C) as in the first embodiment. After step S152, the CPU 10A reads out the contents of a memory M1 (step S166 shown in FIG. 9E). If "0" is stored in the memory M1 ("NO" in step S167), the CPU 10A determines that it is color matching before the start of final printing. If "1" is stored in the memory M1 ("YES" in step S167), the CPU 10A determines that it is color matching during final printing. Since "0" has been stored in the memory M1 in step S101, the CPU 10A determines that it is color matching before the start of final printing, and the flow advances to step S153*a* (FIG. 9F).

In step S153*a*, the CPU 10A reads out the contents of the memory M21. If "0" is stored in the memory M21, the CPU 10A executes processing in steps S155*a* to S157*a*. Alternatively, if "1" is stored in the memory M21, the CPU 10A executes processing in steps S159*a* to S161*a*. If "2" is stored in the memory M21, the CPU 10A executes processing in steps S162*a* to S165*a*.

Next, the CPU 10A reads out a first coefficient α1 from a memory M14 (step S168). The reference correction amount of each ink key opening ratio is multiplied by the readout first coefficient α1 to obtain the correction amount of each ink key opening ratio. The resultant correction amount is stored in a memory M16 (step S169). The resultant correction amounts of the ink key opening ratios are output to motor drivers 11A in motor control devices 11-1 to 11-n (step S172*a*). Upon receiving the ink key opening ratio correction end signals from all the motor control devices 11-1 to 11-n ("YES" in step S173*a*), the flow returns to step S109.

[Change of Allowable Density Difference for Color Matching During Final Printing]

First, "0" is stored in the memory M22. In step S114*b* (FIG. 9B), when the switch SW42 is turned on once, "1" is stored in the memory M22 (step S114*b*→S115*b*→S116*b*→S118*b*). When the switch SW42 is turned on twice, "2" is stored in the memory M22 (step S114*b*→S115*b*→S116*b*→S117*b*→S119*b*).

When the switch SW2 is turned on ("YES" in step S122), the CPU 10A executes the processing in steps S130 to S152. After step S152, the CPU 10A reads out the contents of the memory M1 (step S166 shown in FIG. 9E). If "0" is stored in the memory M1 ("NO" in step S167), the CPU 10A determines that it is color matching before the start of final printing, and the flow advances to step S153. If "1" is stored in the memory M1 ("YES" in step S167), the CPU 10A determines that it is color matching during final printing, and the flow advances to step S153*b* (FIG. 9F).

To execute final printing, the operator turns on a switch SW1 ("YES" in step S109). Accordingly, "1" is stored in the memory M1 (step S110→S111→S112). After that, the CPU 10A determines that it is color matching during final printing (step S167), and the flow advances to step S153*b*.

In step S153*b*, the CPU 10A reads out the contents of the memory M22 (step S153*b*). If "0" is stored in the memory M22, the CPU 10A executes processing in steps S155*b* to S157*b*. If "1" is stored in the memory M22, the CPU 10A executes processing in steps S159*b* to S161*b*. If "2" is stored in the memory M22, the CPU 10A executes processing in steps S162*b* to S165*b*.

Next, the CPU 10A reads out a second coefficient α2 from a memory M15 (step S170). The reference correction amount of each ink key opening ratio is multiplied by the readout second coefficient α2 to obtain the correction amount of each ink key opening ratio. The resultant correction amount is stored in the memory M16 (step S171). The resultant correction amounts of the ink key opening ratios are output to the motor drivers 11A in the motor control devices 11-1 to 11-n (step S172*b*). Upon receiving the ink key opening ratio correction end signals from all the motor control devices 11-1 to 11-n ("YES" in step S173*b*), the flow returns to step S109.

Figure 6:
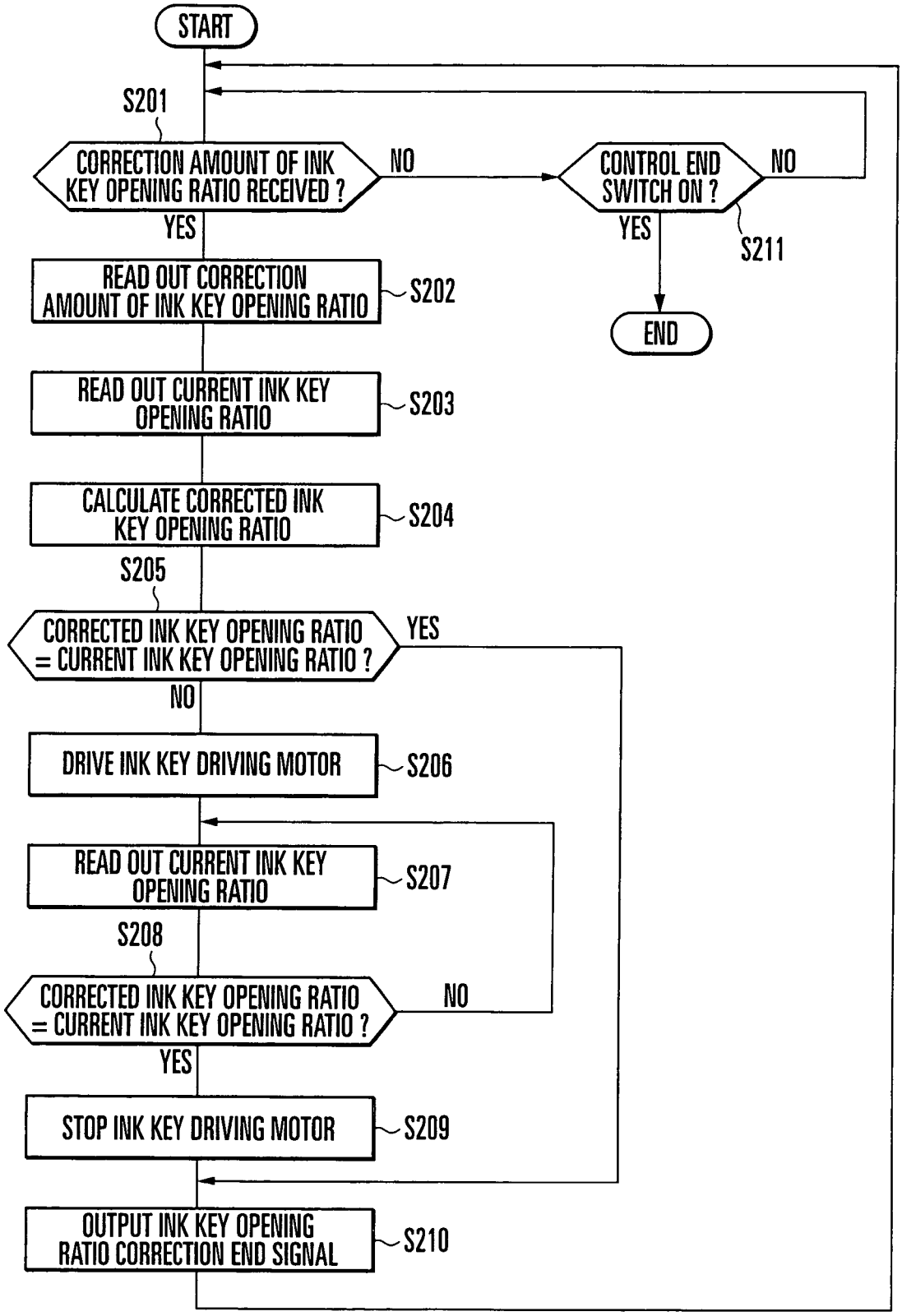
FIG. 6 is a flowchart showing the processing operation of an ink key driving motor control device.
Figure 15A:
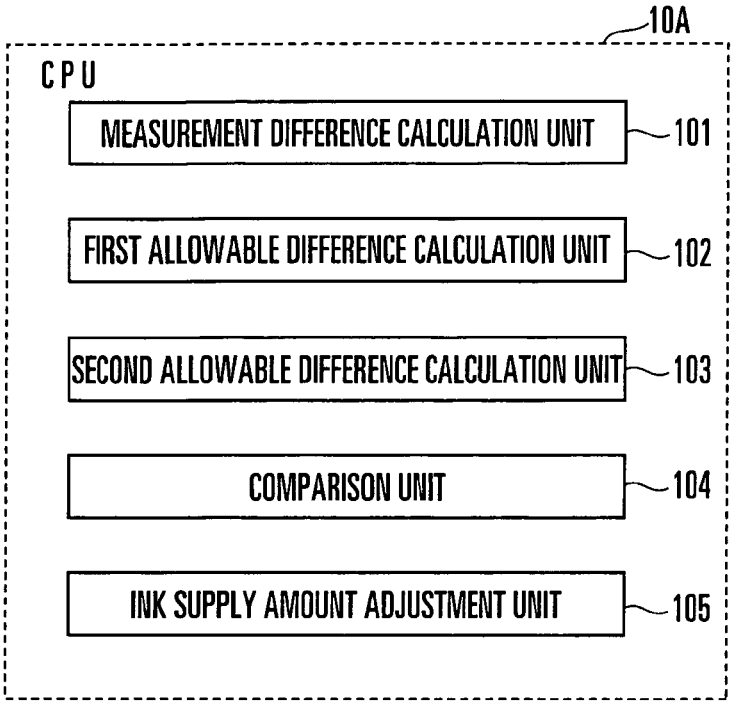
FIGS. 15A and 15B are functional block diagrams of a CPU shown in FIGS. 1 and 7.

The functional block of the CPU 10A shown in FIGS. 1 and 7 will be described below with reference to FIGS. 15A and 15B. As shown in FIG. 15A, the CPU 10A in FIG. 1 includes functional blocks such as a measurement difference calculation unit 101, first allowable difference calculation unit 102, second allowable difference calculation unit 103, comparison unit 104, and ink supply amount adjustment unit 105. The measurement difference calculation unit 101 executes the processing in step S152 (FIG. 5C). The first allowable difference calculation unit 102 executes the processing in step S132 (FIG. 5B). The second allowable difference calculation unit 103 executes the processing in step S134 (FIG. 5B). The comparison unit 104 executes the processing in steps S136 to S139 (FIG. 5B). The ink supply amount adjustment unit 105 executes the processing in steps S156, S157, S160, S161, and S164 to S173 (FIG. 5D), and steps S201 to S211 (FIG. 6).

Figure 7:
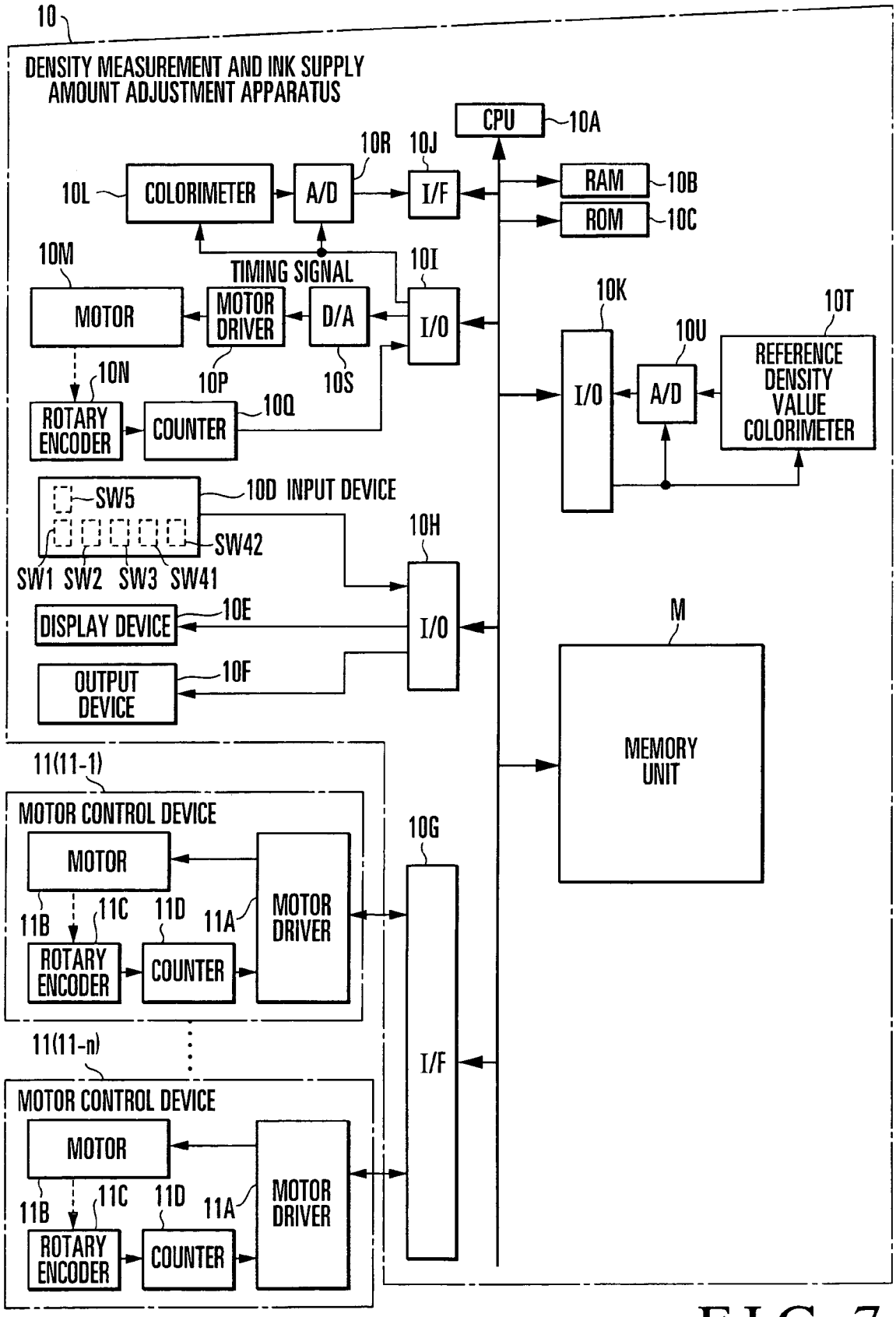
FIG. 7 is a block diagram of an ink supply amount adjustment apparatus according to the second embodiment of the present invention.
Figure 15B:
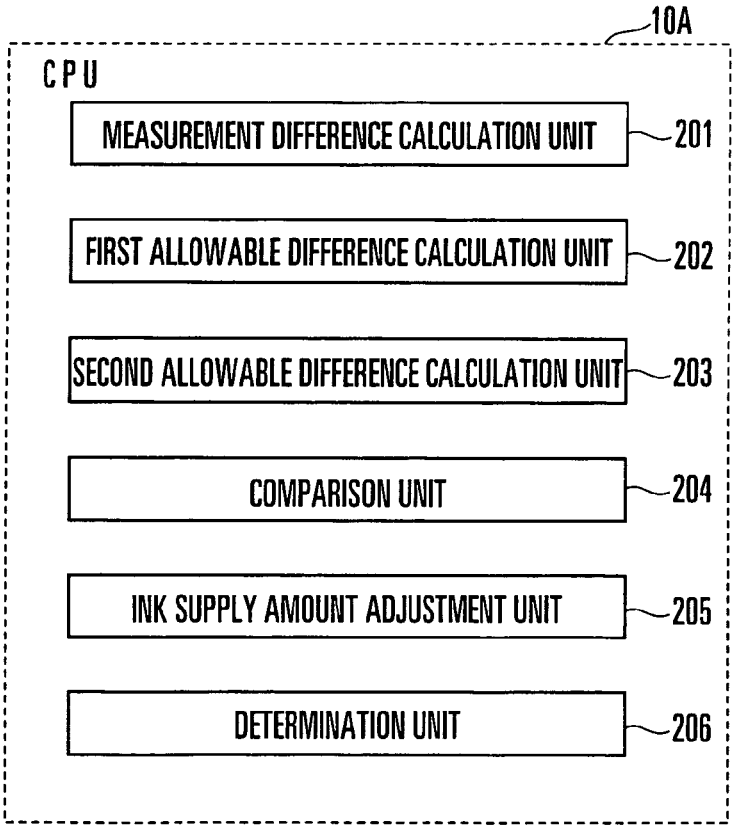
Figure 16:
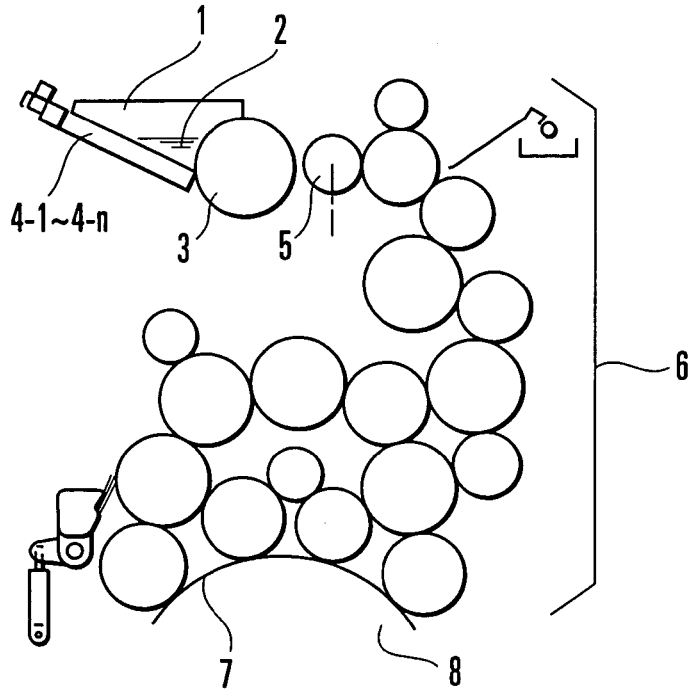
FIG. 16 is a side view of the ink supply apparatus in each color printing unit of a web offset printing press.
Figure 17:
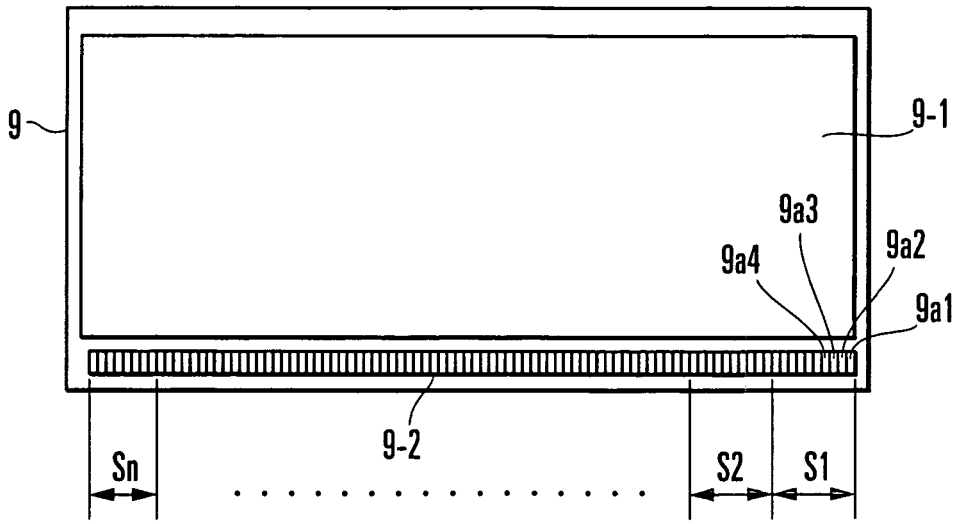
FIG. 17 is a plan view of a printing product printed by a printing press.

As shown in FIG. 15B, the CPU 10A in FIG. 7 includes functional blocks such as a measurement difference calculation unit 201, first allowable difference calculation unit 202, second allowable difference calculation unit 203, comparison unit 204, ink supply amount adjustment unit 205, and determination unit 206. The measurement difference calculation unit 201 executes the processing in step S152 (FIG. 5C). The first allowable difference calculation unit 202 executes the processing in steps S132*a* and S132*b* (FIG. 9C). The second allowable difference calculation unit 203 executes the processing in steps S134*a* and 134*b* (FIG. 9C). The comparison unit 204 executes the processing in steps S136*a* to S139*b* (FIG. 9D). The ink supply amount adjustment unit 205 executes the processing in steps S156*a*, S157*a*, S160*a*, S161*a*, S164*a*, S165*a*, S168, S169, S172*a*, and S173*a* (FIG. 9E), steps S156*b*, S157*b*, S160*b*, S161*b*, S164*b*, S165*b*, S170, S171, S172*b*, and S173*b* (FIG. 9F), and steps S201 to S211 (FIG. 6). The determination unit 206 executes the processing in step S167 (FIG. 9E).

In the above-described embodiments, the density value is obtained on the basis of colorimetric data from the colorimeter. The density value may directly be obtained by using a densitometer in place of the colorimeter. The ink key opening ratio correction value is obtained by multiplying the reference correction amount of the ink key opening ratio by a coefficient (control ratio). Instead, the ink key opening ratio correction amount may be obtained by using a conversion table (storing a conversion curve representing the relationship between the reference correction amount and the correction amount). Before the start of final printing, the correction amount of the ink key opening ratio is obtained by using a first conversion table (storing a conversion curve before the start of final printing). During final printing, the correction amount of the ink key opening ratio is obtained by using a second conversion table (storing a conversion curve during final printing) different from the first conversion table.

Instead of obtaining the ink key correction amount by multiplying the reference correction amount of the ink key opening ratio by a coefficient (control ratio), first and second conversion tables may be arranged. The first conversion table stores the relationship between the density difference and the correction amount before the start of final printing. The second conversion table stores the relationship between the density difference and the correction amount during final printing. In this case, before the start of final printing, the correction amount of the ink key opening ratio is obtained directly from the density difference by using the first conversion table. During final printing, the correction amount of the ink key opening ratio is obtained directly from the density difference by using the second conversion table.

In the first embodiment, the first and second allowable density ratios β1 and β2 are commonly used for the respective colors. However, these first and second allowable density ratios may be set for each color. Similarly, in the second embodiment, the first and second allowable density ratios (before the start of final printing) β1F and β2F and the first and second allowable density ratios (during final printing) β1M and β2M may be set for each color.

In the above embodiments, the color matching operation is executed by using the density value. However, the same color matching operation can be executed in the modification by using the color value in place of the density value.

Figure 10:
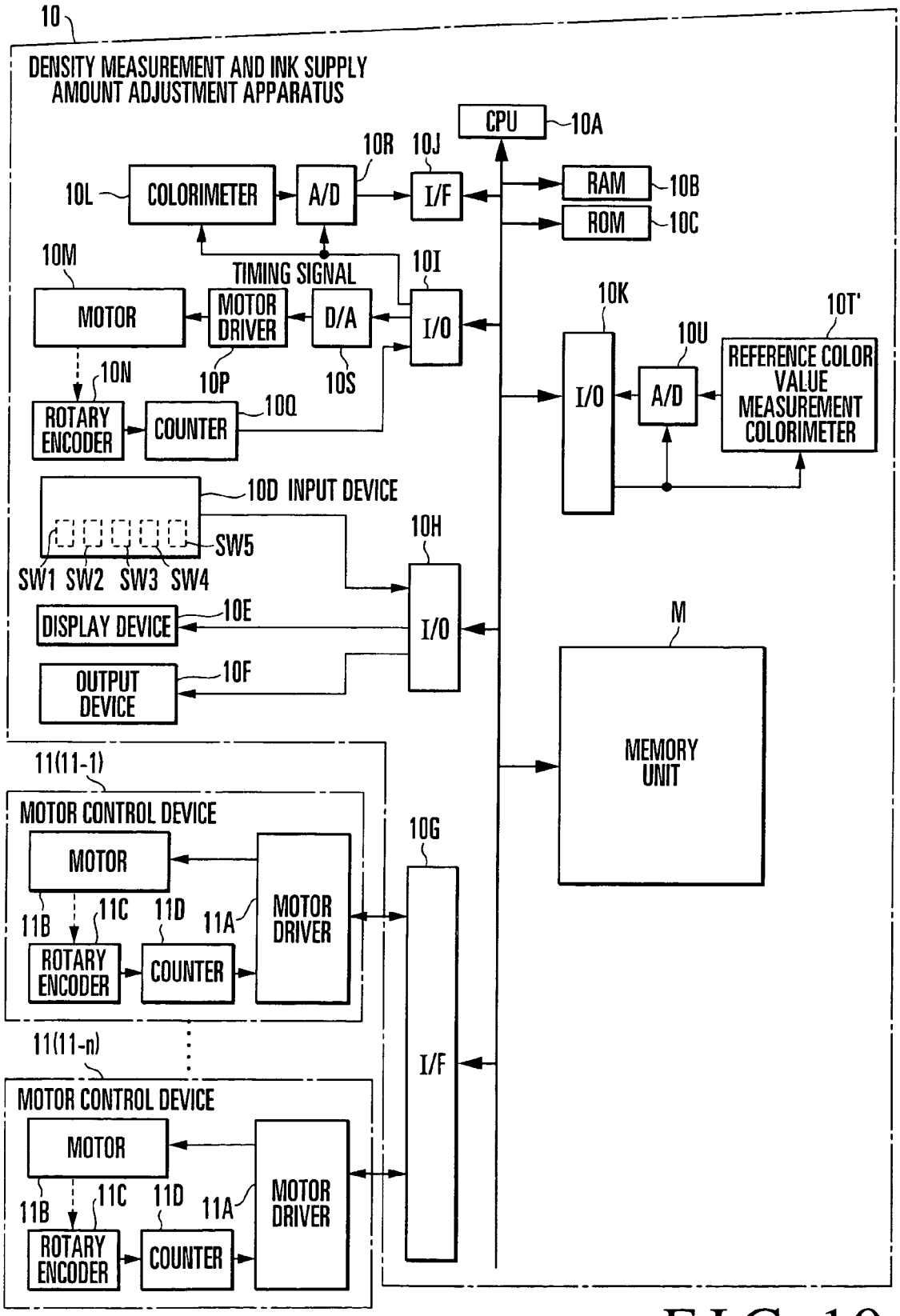
FIG. 10 is a block diagram of an ink supply amount adjustment apparatus according to a modification to the first embodiment when "color-value (ratio)" and "color difference" are used in place of "density value (ratio)" and "density difference"
Figure 11:
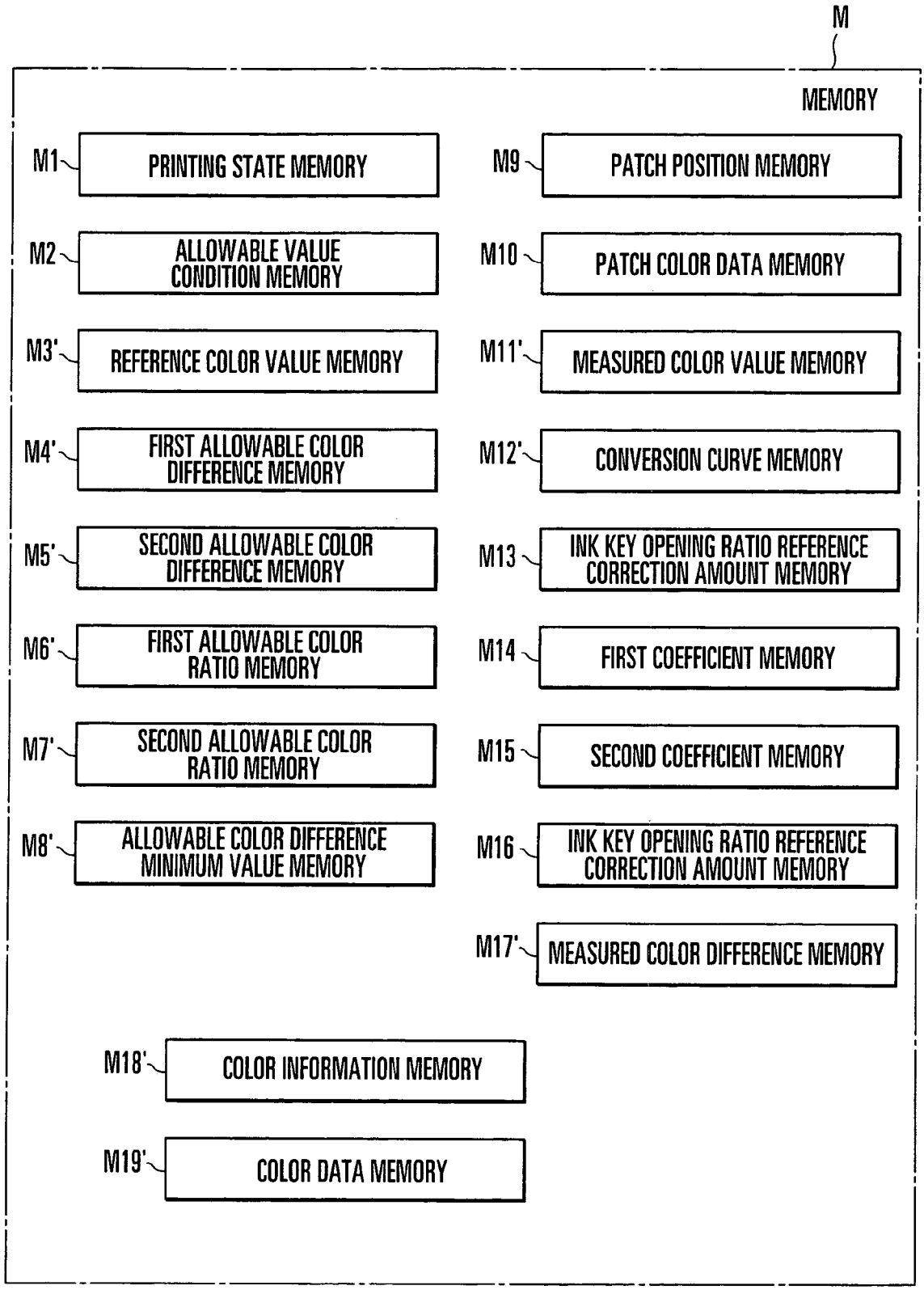
FIG. 11 is a view showing the structure of a memory unit shown in FIG. 10.
Figure 12A:
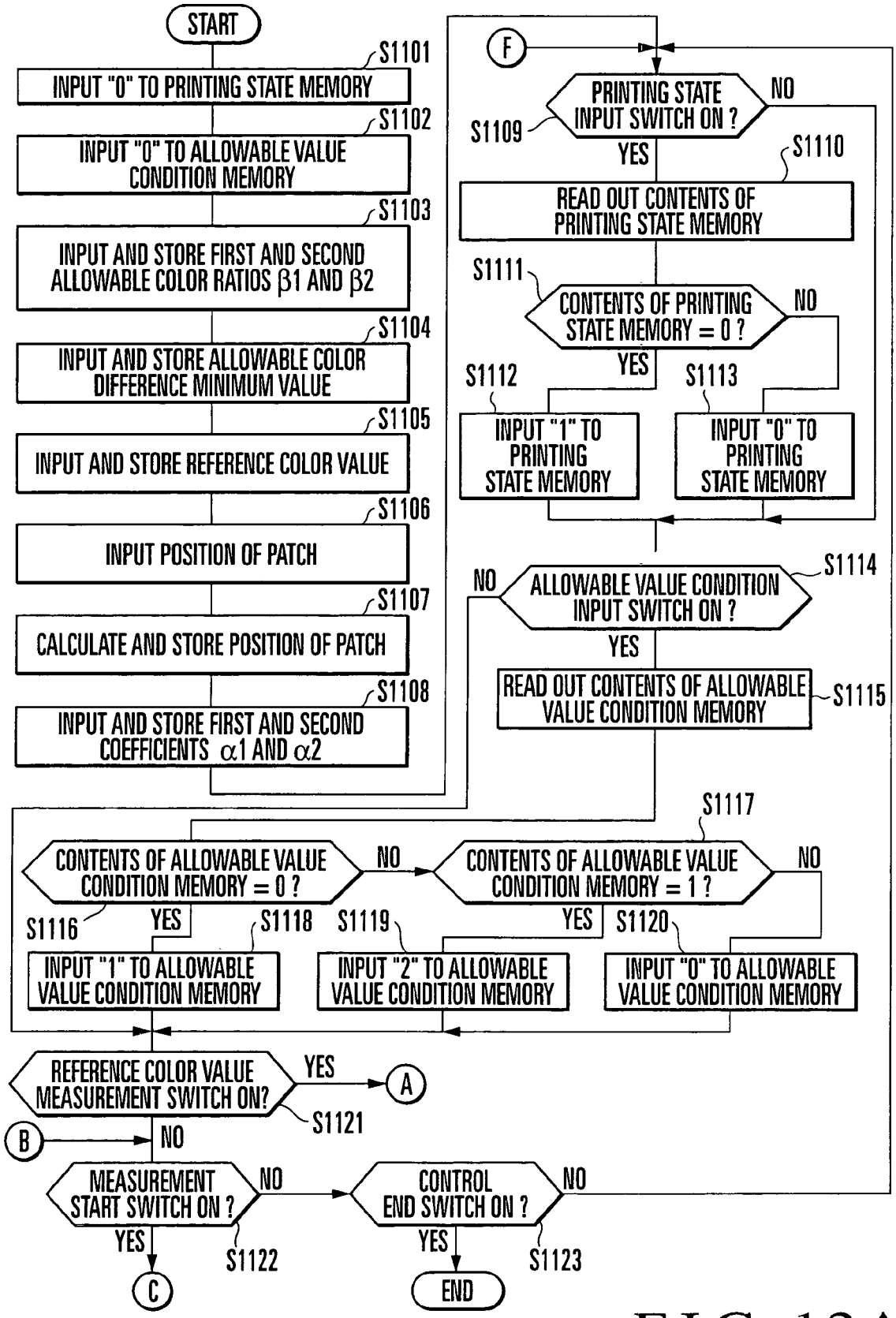
FIGS. 12A to 12E are flowcharts showing the processing operation of the modification shown in FIG. 10.
Figure 12B:
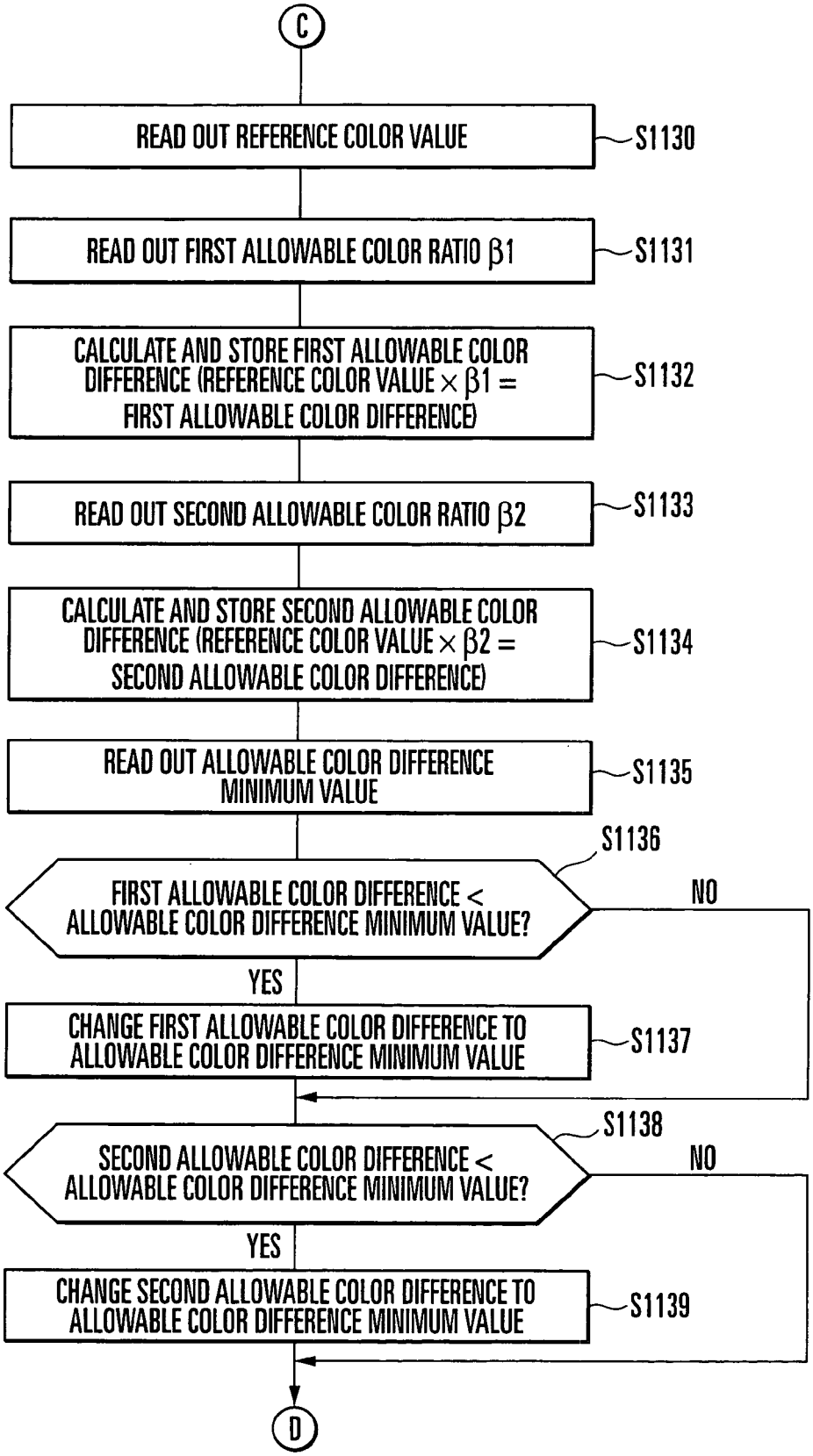
Figure 12C:
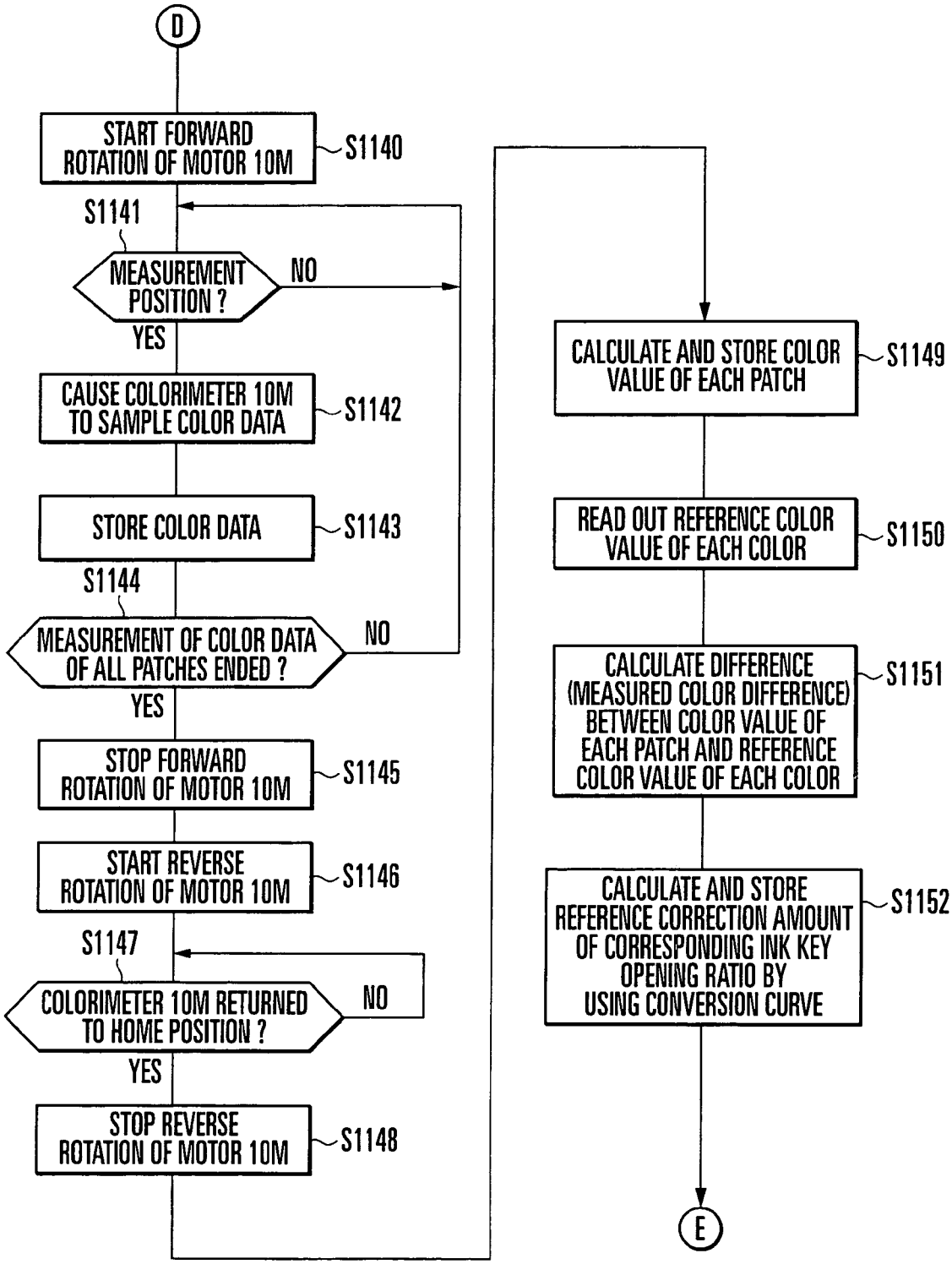
Figure 12D:
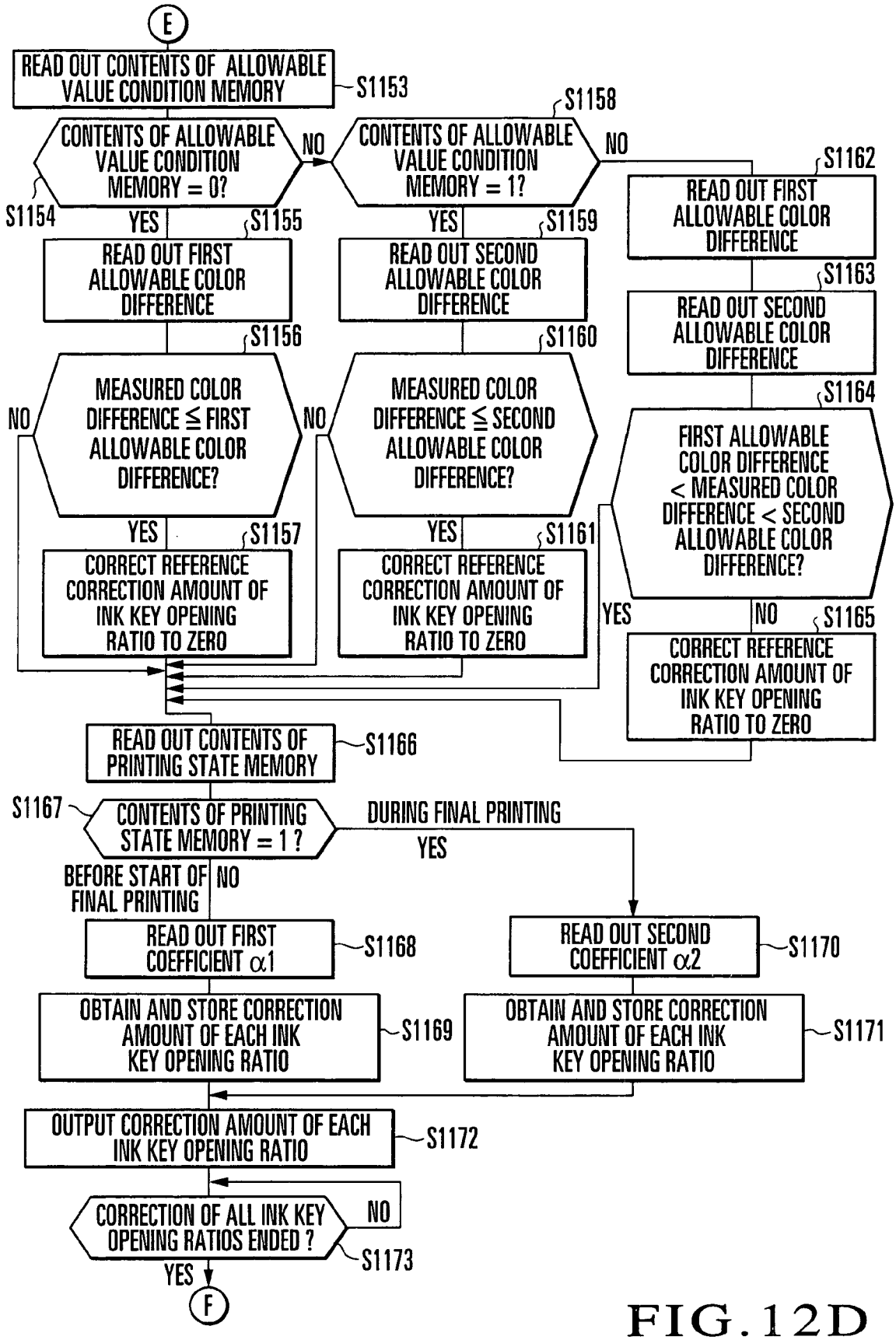
Figure 12E:
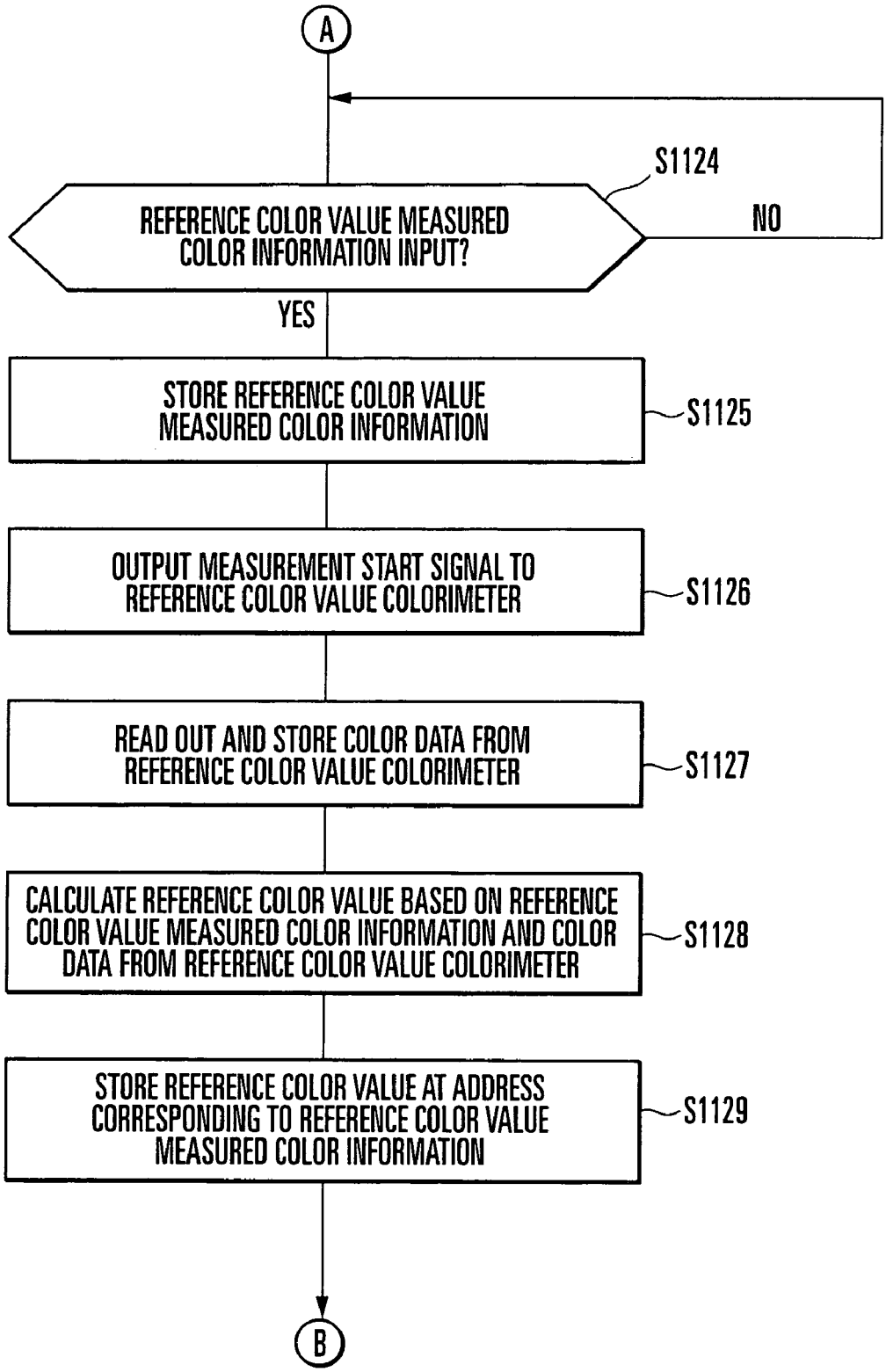

In the modification of the first embodiment, as shown in FIG. 10, the reference density value colorimeter 10T in FIG. 1 is changed to the reference color value calorimeter 10T'. As shown in FIG. 11, the reference density value memory M3, first allowable density difference memory M4, second allowable density difference memory M5, first allowable density ratio memory M6, second allowable density ratio memory M7, allowable density difference minimum value memory M8, measured density value memory M11, conversion curve (conversion curve representing relationship between the difference between the density value and the reference density value of each patch of each color and the adjustment amount of the opening ratio of the ink key) memory M12, measured density difference memory M17, color information (reference density value measured color information) memory M18, and color data (color data from the calorimeter 10T) memory M19 shown in FIG. 2 are respectively changed to a reference color value memory M3', first allowable color difference memory M4', second allowable color difference memory M5', first allowable color ratio memory M6', second allowable color ratio memory M7', allowable color difference minimum value memory M8', patch color value memory M11', conversion curve (conversion curve representing relationship between the difference between the color value and the reference color value of each patch of each color and the adjustment amount of the opening ratio of the ink key) memory M12', measured color difference memory M17', color information (reference color value measured color information) memory M18', and color data (color data from the colorimeter 10T') memory M19'.

Also, "density value" and "density difference" in steps S103 to S105, S121, S124 to S139, S149 to S152, S155, S156, S159, S160, and S162 to S164 shown in FIGS. 5A to 5E are respectively changed to "color value" and "color difference" in steps S1103 to S1105, S1121, S1124 to S1139, S1149 to S1152, S1155, S1156, S1159, S1160, and S1162 to S1164 shown in FIGS. 12A to 12E. Note that, steps in the range of 100 to 199 in FIGS. 5A to 5E correspond to steps in the range of 1000 to 1999 in FIGS. 12A to 12E.

Figure 8:
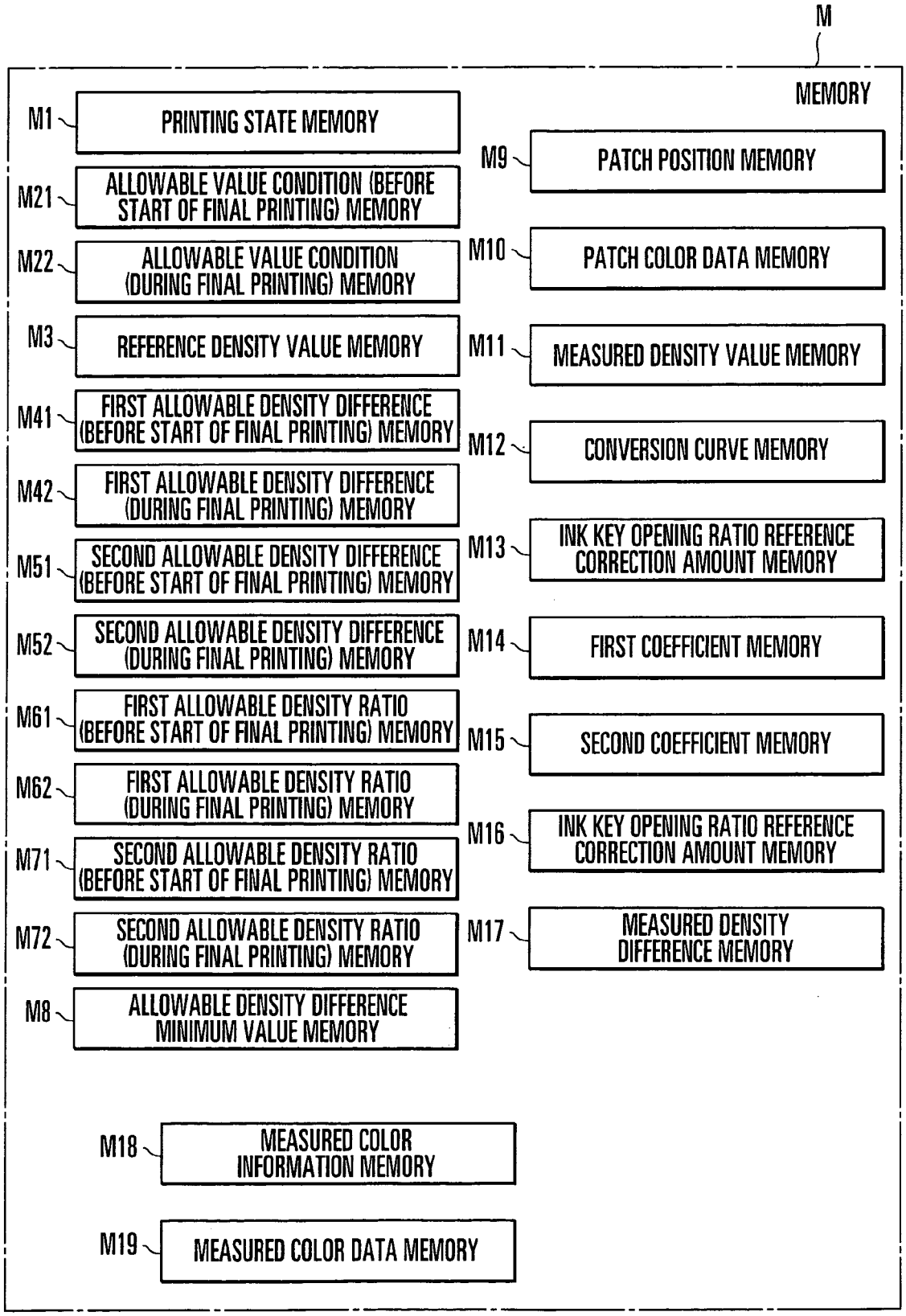
FIG. 8 is a view showing the structure of a memory unit shown in FIG. 7.
Figure 13:
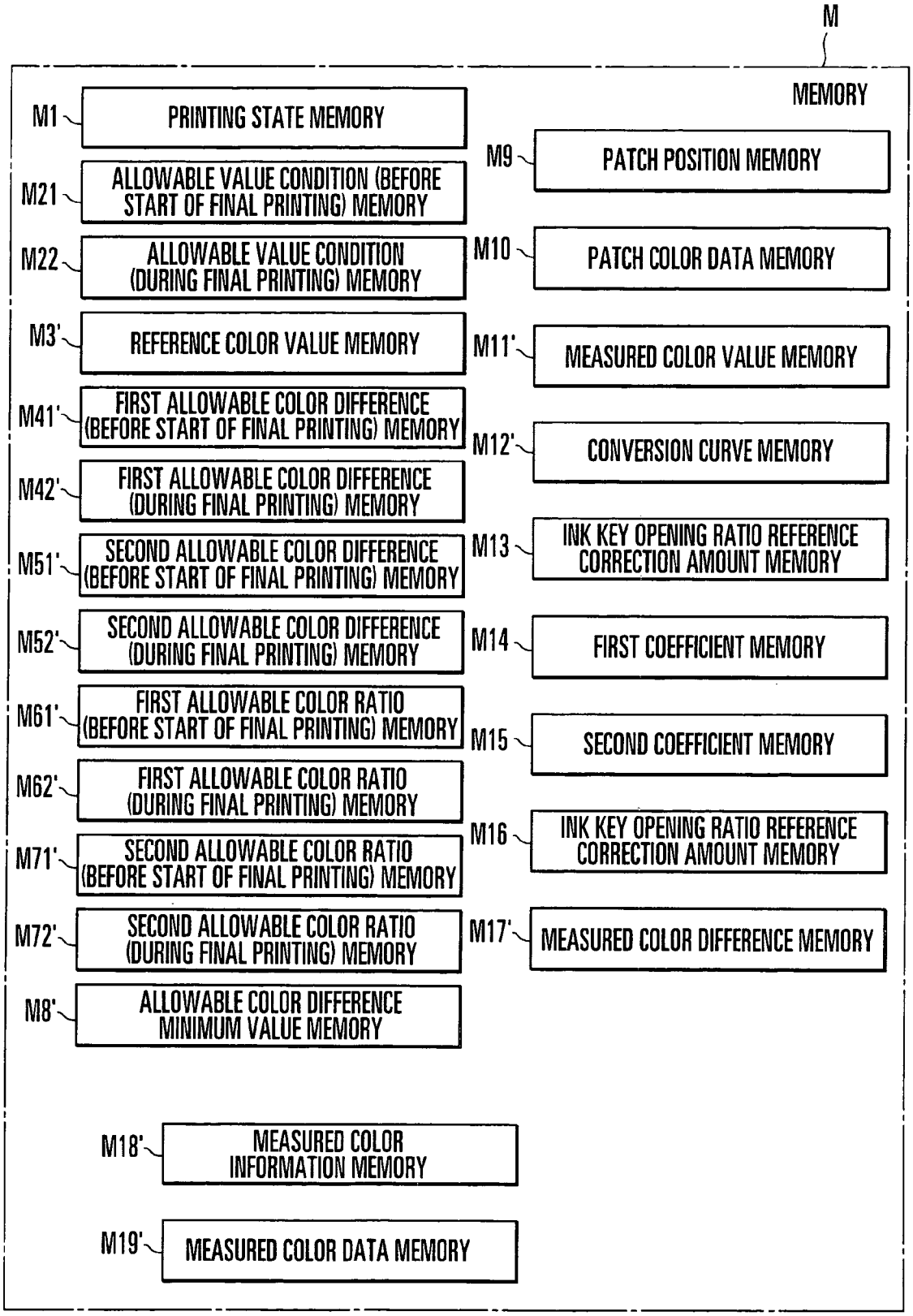
FIG. 13 is a schematic view of a memory unit in an ink supply amount adjustment apparatus according to a modification to the second embodiment when "color value (ratio)" and "color difference" are used in place of "density value (ratio)" and "density difference"
Figure 14A:
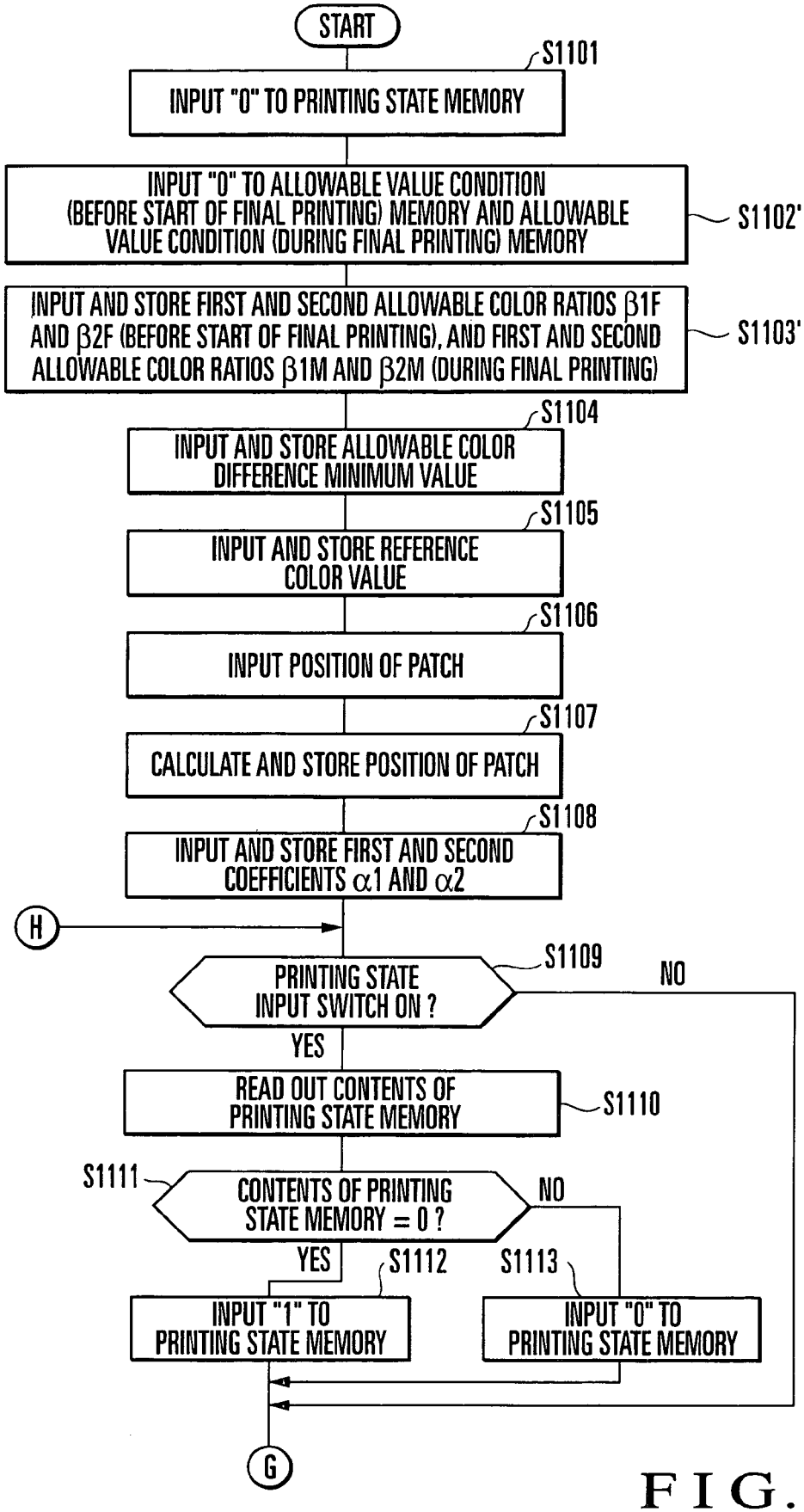
FIGS. 14A to 14F are flowcharts showing the processing operation of the modification shown in FIG. 13.
Figure 14B:
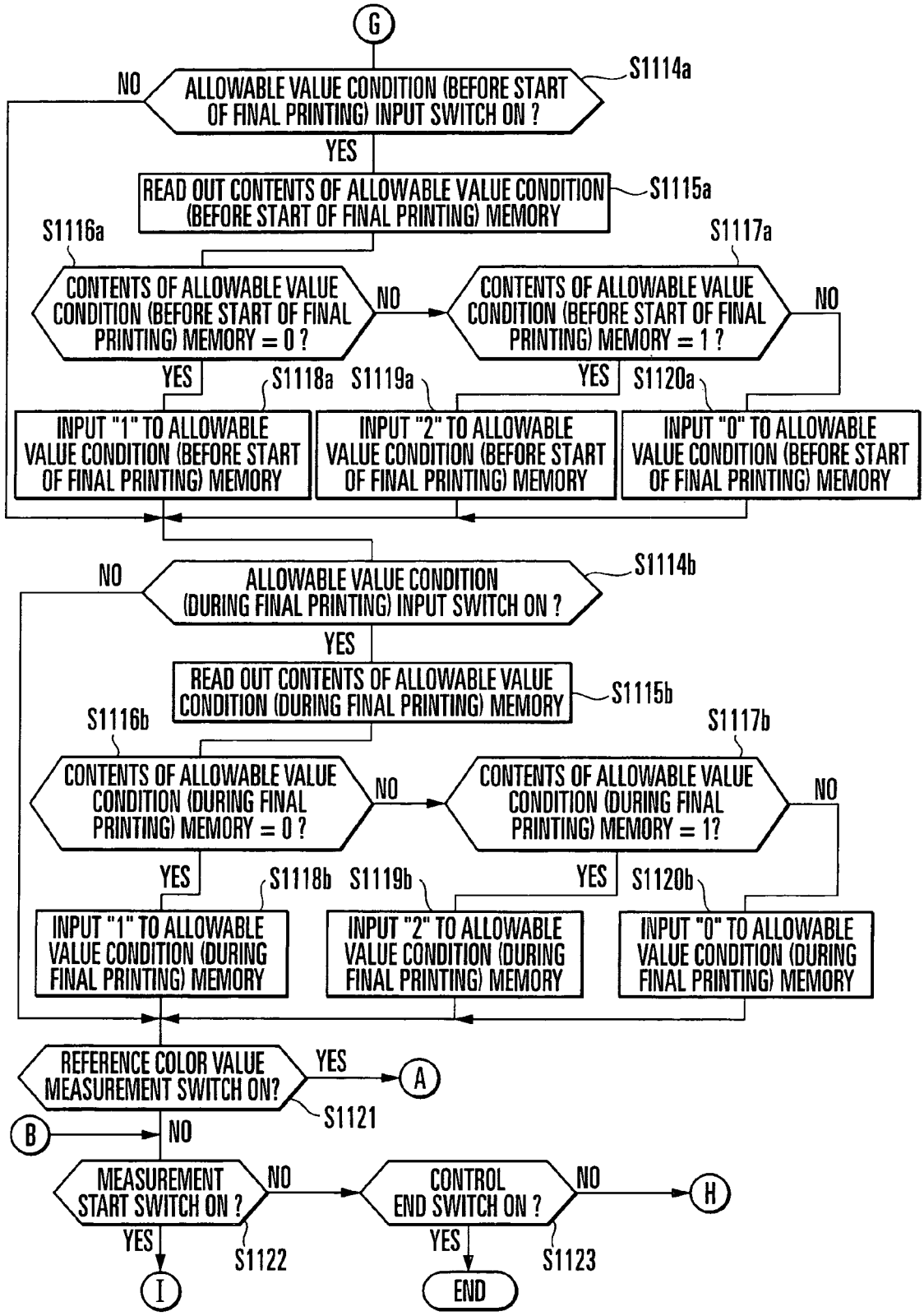
Figure 14C:
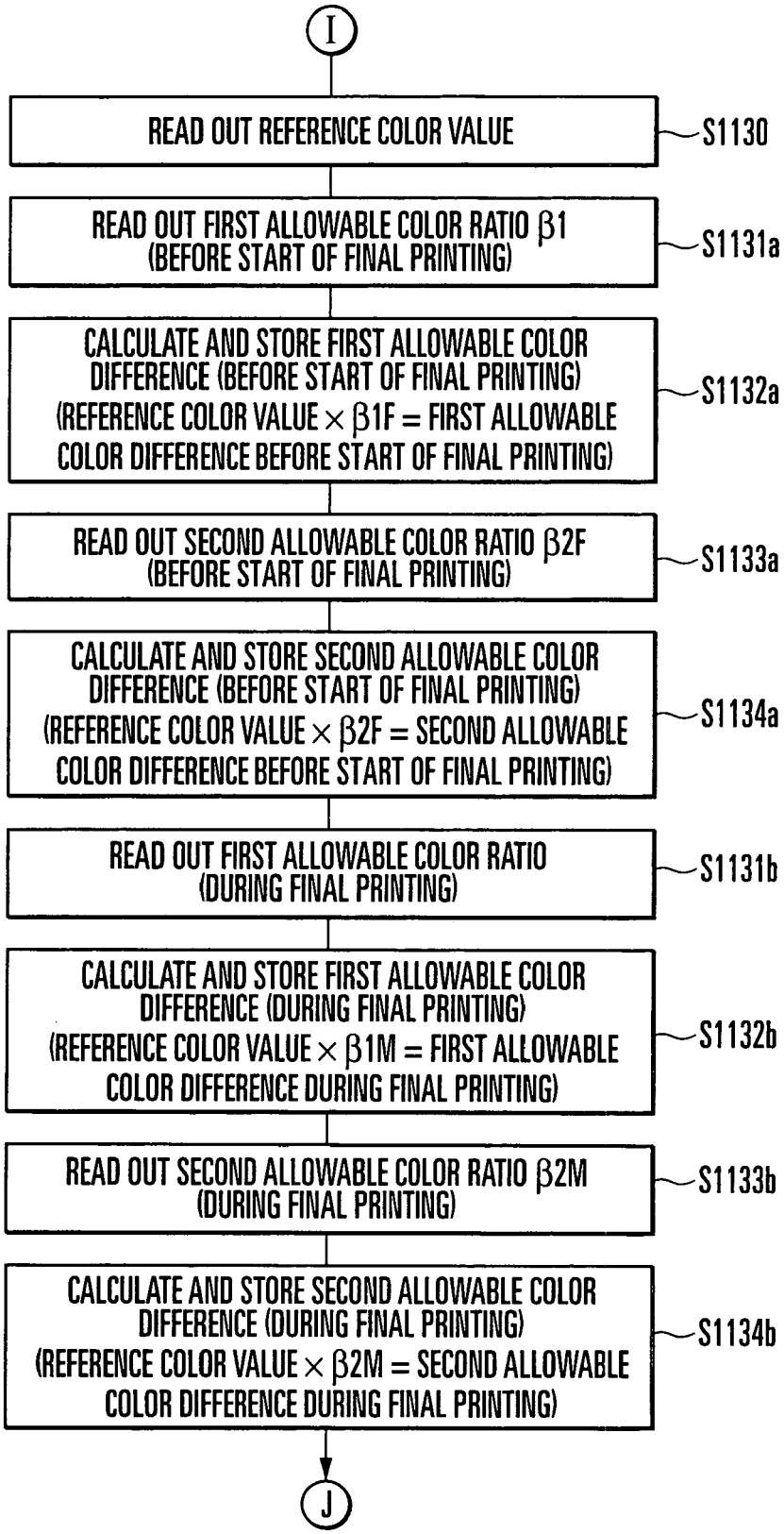
Figure 14D:
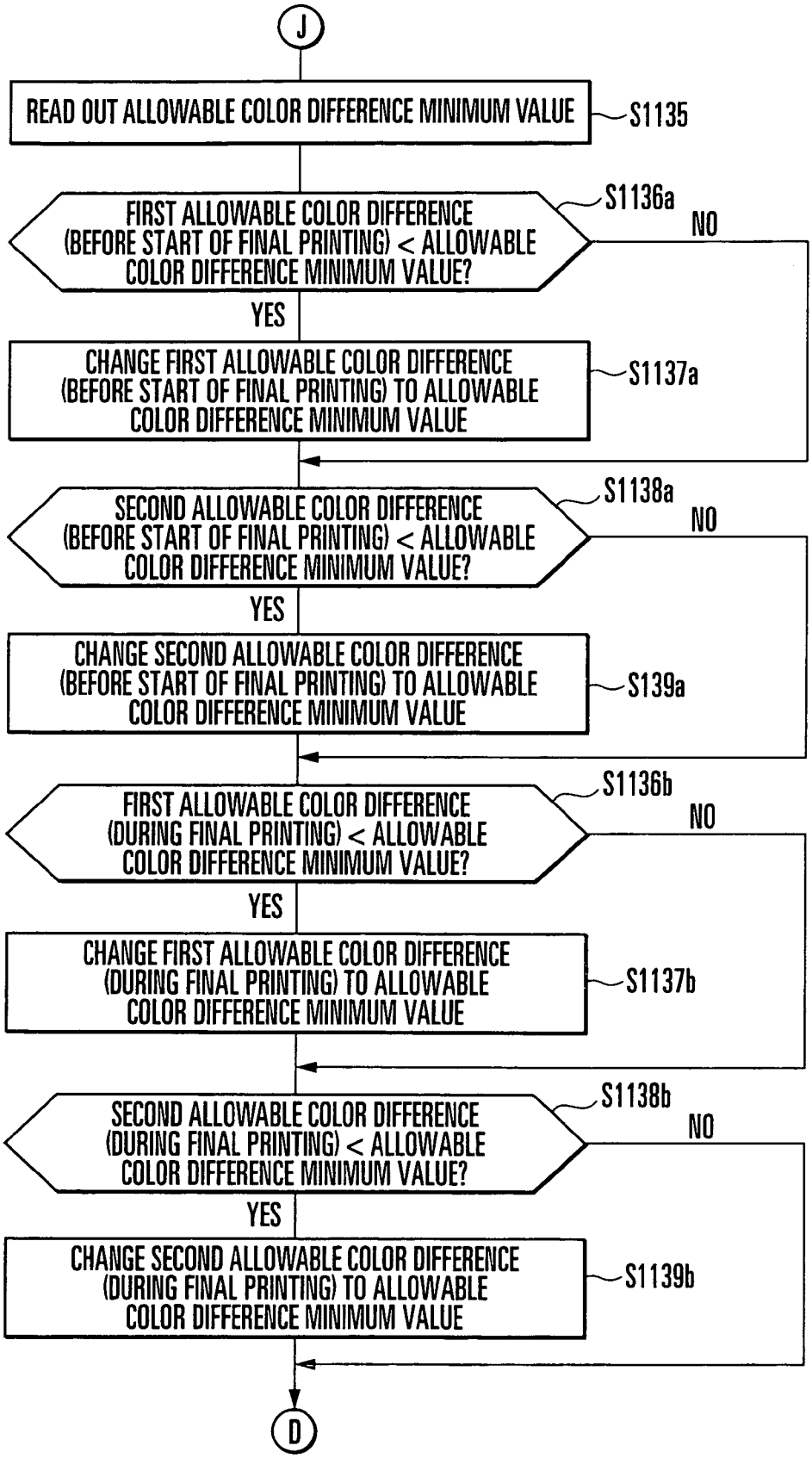
Figure 14E:
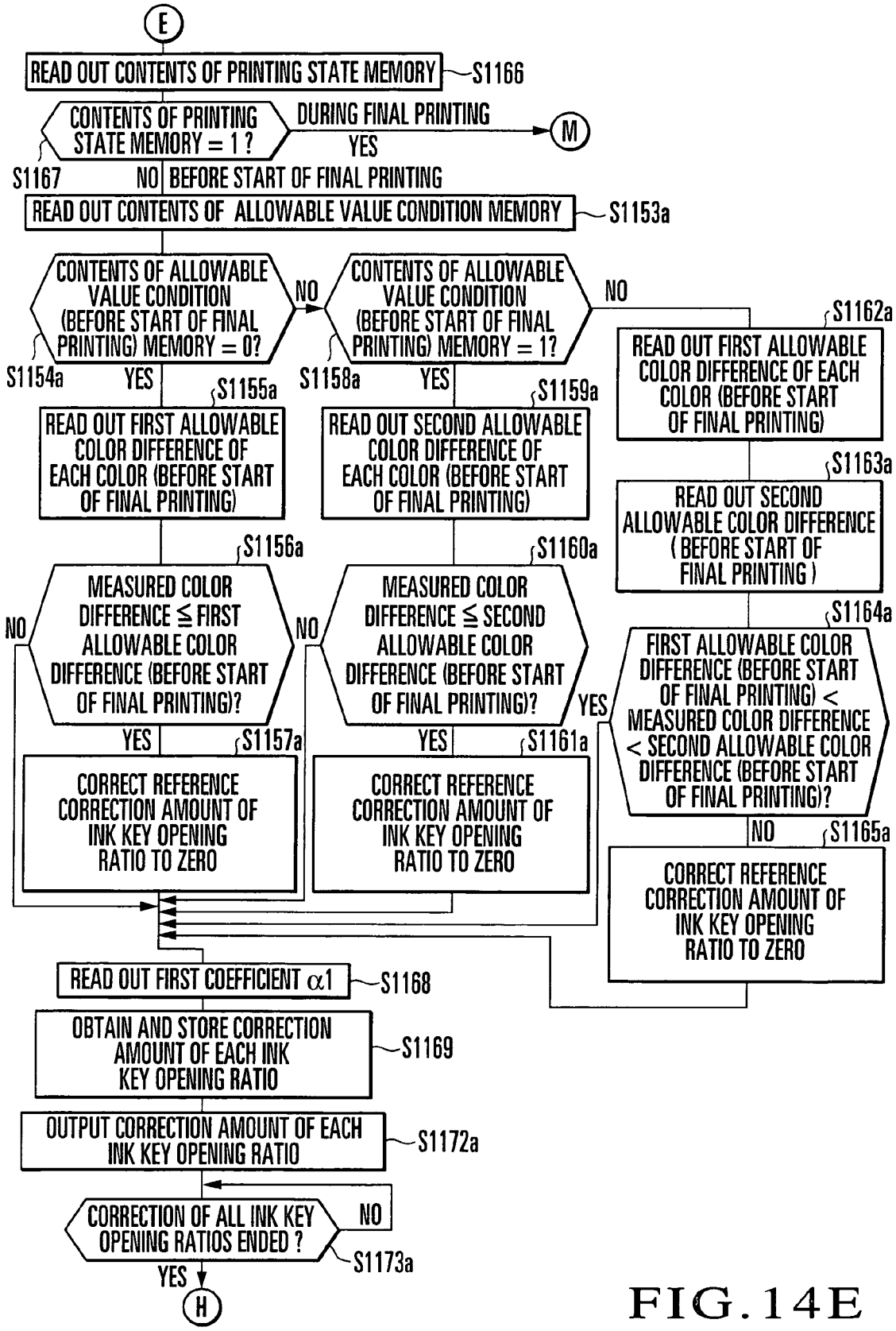
Figure 14F:
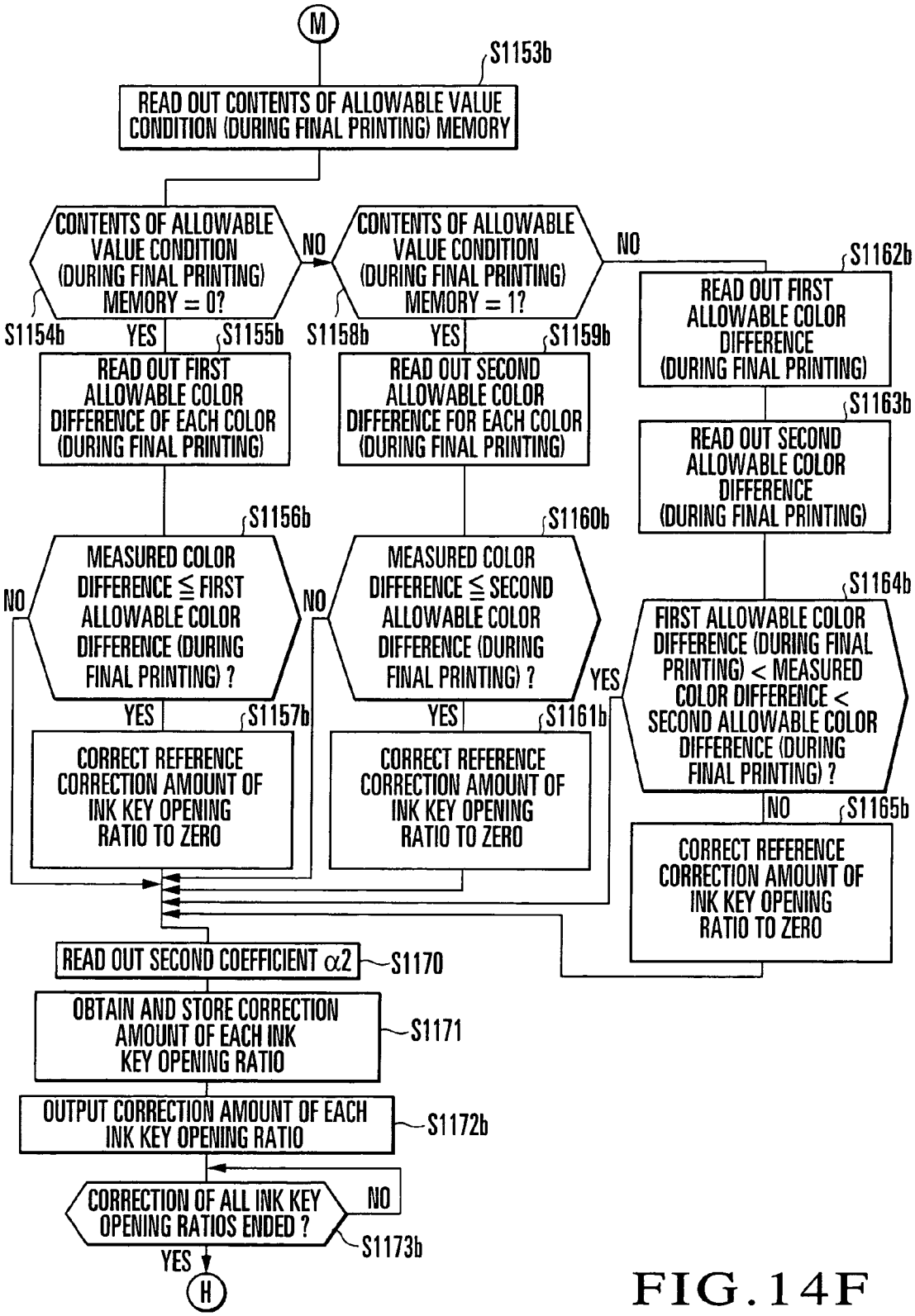

Similarly, in the modification to the second embodiment, the reference density value colorimeter 10T shown in FIG. 7 is changed to the reference color value calorimeter (as the reference color value calorimeter 10T' shown in FIG. 10). As shown in FIG. 13, the reference density value memory M3, first allowable density difference (before the start of final printing) memory M41, first allowable density difference (during final printing) memory M42, second allowable density difference (before the start of final printing) memory M51, second allowable density difference (during final printing) memory M52, first allowable density ratio (before the start of final printing) memory M61, first allowable density ratio (during final printing) memory M62, second allowable density ratio (before the start of final printing) memory M71, second allowable density ratio (during final printing) memory 72, allowable density difference minimum value memory M8, measured density value memory M11, conversion curve (conversion curve representing relationship between the difference between the density value and the reference density value of each patch of each color and the adjustment amount of the opening ratio of the ink key) memory M12, measured density difference memory M17, color information (reference density value measured color information) memory M18, and color data (color data from the colorimeter 10T) memory M19 shown in FIG. 8 are respectively changed to a reference color value memory M3', first allowable color difference (before the start of final printing) memory M41', first allowable color difference (during final printing) memory M42', second allowable color difference (before the start of final printing) memory M51', second allowable color difference (during final printing) memory M52', first allowable color ratio (before the start of final printing) memory M61', first allowable color ratio (during final printing) memory M62', second allowable color ratio (before the start of final printing) memory M71', second allowable color ratio (during final printing) memory M72', allowable color difference minimum value memory M8', patch color value memory M11', conversion curve (conversion curve representing relationship between the difference between the color value and the reference color value of each patch of each color and the adjustment amount of the opening ratio of the ink key) memory M12', measured color difference memory M17', color information (reference color value measured color information) memory M18', and color data (color data from the reference color value colorimeter) memory M19'.

Also, "density value (ratio)" and "density difference" in steps S103', S104, S105, S121, S130 to S139*b*, S155*a*, S155*b*, S156*a*, S156*b*, S159*a*, S159*b*, S160*a*, S160*b*, S162*a* to S164*a*, and S162*b* to S164*b* shown in FIGS. 9A to 9F are respectively changed to "color value (ratio)" and "color difference" in steps S1103', S1104, S1105, S1121, S1130 to S1139*b*, S1155*a*, S1155*b*, S1156*a*, S1156*b*, S1159*a*, S159*b*, S1160*a*, S1160*b*, S1162*a* to S1164*a*, and S1162*b* to S1164*b* shown in FIGS. 14A to 14F. As the modification to the first embodiment, "density value (ratio)" and "density difference" in steps S149 to S152 shown in FIG. 5C are respectively changed to "color value (ratio)" and "color difference" in steps S1149 to S1152 shown in FIG. 12C. Note that, steps in the range of 100 to 199 in FIGS. 9A to 9F correspond to steps in the range of 1000 to 1999 in FIGS. 14A to 14E.

In two modifications described above, the CPU 10A obtains not the density value but a color value from the color data sampled by the calorimeter 10L. A color value indicates an "L* value, a* value, and b* value" represented by the L*a*b* calorimetric system or an "L* value, u* value, and v* value" represented by the L*u*v calorimetric system as a color display method defined by JIS Z8729 in the Japanese Industrial Standard (JIS) and recommended by the Commission Internationale de l'Eclairage (CIE).

Note that, in the above embodiments and modifications, in the relationship between the allowable density difference (color difference) and the allowable density difference (color difference) minimum value, and the relationship between the difference between the measured density difference (color difference) and reference density difference (color difference) and the allowable density difference (color difference), "larger than" and "smaller than" may be changed to "equal to or larger than" and "equal to or smaller than" to obtain the same effect. Alternatively, "equal to or larger than" and "equal to or smaller than" may be changed to "larger than" and "smaller than".

In this embodiment, since the allowable density ratio (or allowable color ratio) is set, the adequate value of the allowable density difference (or allowable color difference) can be automatically set in accordance with the reference density value (or reference color value) of the ink, even when using special ink which has never (rarely) been used.

According to the present invention, before color matching is performed by the operator or the manager of the site of printing, an adequate ink supply amount adjusting step is selected from the three modes. Hence, the hunting phenomenon of the ink thickness on the paper sheet can be suppressed. In addition, the amount of wasted paper can be decreased even when an unexpected accident has occurred on a printing product.

Assume that the ink supply amount is first adjusted upon selecting the first ink supply amount adjustment mode. Whenever the measured density difference is larger than the first allowable density difference, the ink supply amount is adjusted. On the basis of the color matching result obtained upon selecting the first ink supply amount adjustment mode, when it is determined that the hunting phenomenon of the ink thickness may occur on the paper sheet, the processing operation is changed to adjustment of the ink supply amount by selecting the second ink supply amount adjustment mode. In the second ink supply amount adjustment mode, only when the measured density difference is larger than the second allowable density difference (>first allowable density difference), the ink supply amount is adjusted. That is, the threshold value for adjustment of the ink supply amount is made large. Accordingly, the hunting phenomenon of the ink thickness on the paper sheet can be suppressed.

In addition, when the density value of a specific part of the printing product temporarily largely varies due to an unexpected accident (paper fold error, paper breakage, or smear) on the printing product, the third ink supply amount adjustment mode is selected. In the third ink supply amount adjustment mode, only when the measured density difference falls between the first allowable density difference and the second allowable density difference, the ink supply amount is adjusted. Hence, even when the measured density difference exceeds the second allowable density value, the ink supply amount is not adjusted. Accordingly, the amount of wasted paper generated by the temporary variation in density value can be decreased.

The color matching operation can be selectively done before the start of final printing, or during final printing. In color matching before the start of final printing, the ink amount in the inker is often largely different from the ink amount necessary for a printing product to be printed. Hence, the measured density difference is large. To the contrary, in color matching during final printing, the ink amount in the inker is not so different from the ink amount necessary for a printing product to be printed. Hence, the measured density difference is small.

What is claimed is:

1. An ink supply amount adjustment method for a printing press, comprising the steps of:

measuring one of a density value and a color value of a printing product;

obtaining a difference between the measurement value and a preset reference value, as a measurement difference;

setting a first error ratio allowed with respect to the preset reference value, as a first allowable ratio;

obtaining a first allowable difference from the preset reference value and the set first allowable ratio; and adjusting an ink supply amount on the basis of the obtained measurement difference and the obtained first allowable difference.

2. A method according to claim 1, wherein the measuring step comprises the step of measuring the density value of the printing product, the measurement difference obtaining step comprises the step of obtaining a difference between the measured density value and the preset reference density value, as a measured density difference, the setting step comprises the step of setting a first error ratio allowed with respect to the preset reference density value, as a first allowable density ratio, the first allowable difference obtaining step comprises the step of obtaining a first allowable density difference from the preset reference density value and the set first allowable density ratio, and the adjusting step comprises the step of adjusting an ink supply amount on the basis of the obtained measured density difference and the first allowable density difference.

3. A method according to claim 1, wherein the measuring step comprises the step of measuring the color value of the printing product, the measurement difference obtaining step comprises the step of obtaining a difference between the measured color value and the preset reference color value, as a measured color difference, the setting step comprises the step of setting a first error ratio allowed with respect to the preset reference color value, as a first allowable color ratio, the first allowable difference obtaining step comprises the step of obtaining a first allowable color difference from the preset reference color value and the set first allowable color ratio, and the adjusting step comprises the step of adjusting an ink supply amount on the basis of the obtained measured color difference and the first allowable color difference.

4. A method according to claim 1, further comprising the steps of setting a measurement difference minimum value for adjusting the ink supply amount, as an allowable difference minimum value, comparing the obtained first allowable difference with the set allowable difference minimum value, and changing the first allowable difference to the allowable difference minimum value when the first allowable difference is smaller than the allowable difference minimum value.

5. A method according to claim 1, further comprising the steps of setting a second error ratio allowed with respect to the preset reference value, as a second allowable ratio, and obtaining a second allowable difference from the preset reference value and the set second allowable ratio, wherein the adjusting step comprises the step of selecting one of a first mode of adjusting the ink supply amount when the obtained measurement difference is larger than the first allowable difference, a second mode of adjusting the ink supply amount when the obtained measurement difference is larger than the second allowable difference, and a third mode of adjusting the ink supply amount when the obtained measurement difference is larger than the first allowable difference and smaller than the second allowable difference.

6. A method according to claim 5, further comprising the step of determining one of color matching before a start of final printing and color matching during final printing, wherein when color matching is executed before the start of final printing, in the adjusting step, the ink supply amount is adjusted by using the first allowable difference and the second allowable difference which are obtained from the set first allowable ratio and the set second allowable ratio for color matching before the start of final printing.

7. A method according to claim 6, wherein the first allowable ratio setting step comprises the step of setting a first error ratio before the start of final printing allowed with respect to the reference value, as a first allowable ratio for color matching before the start of final printing, the second allowable ratio setting step comprises the step of setting a second error ratio before the start of final printing allowed with respect to the reference value, as a second allowable ratio for color matching before the start of final printing, the first allowable difference obtaining step comprises the step of obtaining the first allowable difference for color matching before the start of final printing from the reference value and the first allowable ratio for color matching before the start of final printing, and the second allowable difference obtaining step comprises the step of obtaining the second allowable difference for color matching before the start of final printing from the reference value and the second allowable ratio for color matching before the start of final printing, wherein the adjusting step comprises the step of selecting one of a first mode before the starting of final printing to adjust the ink supply amount when the measurement difference is larger than the first allowable difference for color matching before the start of final printing, a second mode before the start of final printing to adjust the ink supply amount when the measurement difference is larger than the second allowable difference for color matching before the start of final printing, and a third mode before the start of final printing to adjust the ink supply amount when the measurement difference is larger than the first allowable difference for color matching before the start of final printing and smaller than the second allowable difference for color matching before the start of final printing.

8. A method according to claim 5, further comprising the step of determining one of color matching before a start of final printing and color matching during final printing, wherein when color matching is executed during final printing, in the adjusting step, the ink supply amount is adjusted by using the first allowable difference and the second allowable difference which are obtained from the set first allowable ratio and the set second allowable ratio for color matching during final printing.

9. A method according to claim 8, wherein the first allowable ratio setting step comprises the step of setting a first error ratio during final printing allowed with respect to the reference value, as a first allowable ratio for color matching during final printing, the second allowable ratio setting step comprises the step of setting a second error ratio during final printing allowed with respect to the reference value, as a second allowable ratio for color matching during final printing, the first allowable difference obtaining step comprises the step of obtaining the first allowable difference for color matching during final printing from the reference value and the first allowable ratio for color matching during final printing, and the second allowable difference obtaining step comprises the step of obtaining the second allowable difference for color matching during final printing from the reference value and the second allowable ratio for color matching during final printing, wherein the adjusting step comprises the step of selecting one of a first mode during final printing to adjust the ink supply amount when the measurement difference is larger than the first allowable difference for color matching during final printing, a second mode during final printing to adjust the ink supply amount when the measurement difference is larger than the second allowable difference for color matching during final printing, and a third mode during final printing to adjust the ink supply amount when the measurement difference is larger than the first allowable difference for color matching during final printing and smaller than the second allowable difference for color matching during final printing.

10. An ink supply amount adjustment apparatus for a printing press, comprising:

measurement means for measuring one of a density value and a color value of a printing product;

measurement difference calculation means for obtaining a difference between a measurement value output from said measurement means and a preset reference value as a measurement difference;

first allowable ratio setting means for setting a first error ratio allowed with respect to the preset reference value, as a first allowable ratio;

first allowable difference calculation means for obtaining a first allowable difference from the preset reference value and the first allowable ratio output from said first allowable ratio setting means; and ink supply amount adjustment means for adjusting an ink supply amount on the basis of the measurement difference output from said measurement difference calculation means and the first allowable difference output from said first allowable difference calculation means.

11. An apparatus according to claim 10, wherein said measurement means measures the density value of the printing product, said measurement difference calculation means obtains a difference between the measured density value output from said measurement means and the preset reference density value, as a measured density difference, said first allowable ratio setting means sets a first error ratio allowed with respect to the preset reference density value, as a first allowable density ratio, said first allowable difference calculation means obtains a first allowable density difference from the preset reference density value and the first allowable density ratio output from said first allowable ratio setting means, and said ink supply amount adjustment means adjusts an ink supply amount on the basis of the measured density difference output from said measurement difference calculation means and the first allowable density difference output from said first allowable difference calculation means.

12. An apparatus according to claim 10, wherein said measurement means measures the color value of the printing product, said measurement difference calculation means obtains a difference between the measured color value output from said measurement means and the preset reference color value, as a measured color difference, said first allowable ratio setting means sets a first error ratio allowed with respect to the preset reference color value, as a first allowable color ratio, said first allowable difference calculation means obtains a first allowable color difference from the preset reference color value and the first allowable color ratio output from said first allowable ratio setting means, and said ink supply amount adjustment means adjusts an ink supply amount on the basis of the measured color difference output from said measurement difference calculation means and the first allowable color difference output from said first allowable difference calculation means.

13. An apparatus according to claim 10, further comprising minimum value setting means for setting a measurement difference minimum value for adjusting the ink supply amount, as an allowable difference minimum value, and comparison means for comparing the first allowable difference output from said first allowable difference calculation means with the allowable difference minimum value output from said minimum value setting means, and changing the first allowable difference to the allowable difference minimum value when the first allowable difference is smaller than the allowable difference minimum value.

14. An apparatus according to claim 10, further comprising second allowable ratio setting means for setting a second error ratio allowed with respect to the preset reference value, as a second allowable ratio, and second allowable difference calculation means for obtaining a second allowable difference from the preset reference value and the second allowable ratio output from said second allowable ratio setting means, wherein said ink supply amount adjustment means selects one of a first mode of adjusting the ink supply amount when the measurement difference output from said measurement difference calculation means is larger than the first allowable difference, a second mode of adjusting the ink supply amount when the measurement difference output from said measurement difference calculation means is larger than the second allowable difference, and a third mode of adjusting the ink supply amount when the measurement difference output from said measurement difference calculation means is larger than the first allowable difference and smaller than the second allowable difference.

15. An apparatus according to claim 10, further comprising determination means for determining one of color matching before a start of final printing and color matching during final printing, wherein when color matching is executed before the start of final printing, said ink supply amount adjustment means adjusts the ink supply amount by using the first allowable difference and the second allowable difference for color matching before the start of final printing, which are obtained from the set first allowable ratio and the set second allowable ratio for color matching before the start of final printing.

16. An apparatus according to claim 15, wherein said first allowable ratio setting means sets a first error ratio before the start of final printing allowed with respect to the reference value, as a first allowable ratio for color matching before the start of final printing, said second allowable ratio setting means sets a second error ratio before the start of final printing allowed with respect to the reference value, as a second allowable ratio for color matching before the start of final printing, said first allowable difference calculation means obtains the first allowable difference for color matching before the start of final printing from the reference value and the first allowable ratio for color matching before the start of final printing, and said second allowable difference calculation means obtains the second allowable difference for color matching before the start of final printing from the reference value and the second allowable ratio for color matching before the start of final printing, wherein said ink supply amount adjustment means selects one of a first mode before the starting of final printing to adjust the ink supply amount when the measurement difference is larger than the first allowable difference for color matching before the start of final printing, a second mode before the start of final printing to adjust the ink supply amount when the measurement difference is larger than the second allowable difference for color matching before the start of final printing, and a third mode before the start of final printing to adjust the ink supply amount when the measurement difference is larger than the first allowable difference for color matching before the start of final printing and smaller than the second allowable difference for color matching before the start of final printing.

17. An apparatus according to claim 10, further comprising determination means for determining one of color matching before a start of final printing and color matching during final printing, wherein when color matching is executed during final printing, said ink supply amount adjustment means adjusts the ink supply amount by using the first allowable difference and the second allowable difference for color matching during final printing, which are obtained from the set first allowable ratio and the set second allowable ratio for color matching during final printing.

18. An apparatus according to claim 17, wherein said first allowable ratio setting means sets a first error ratio during final printing allowed with respect to the reference value, as a first allowable ratio for color matching during final printing, said second allowable ratio setting means sets a second error ratio during final printing allowed with respect to the reference value, as a second allowable ratio for color matching during final printing, said first allowable difference calculating means obtains the first allowable difference for color matching during final printing from the reference value and the first allowable ratio for color matching during final printing, and said second allowable difference calculation means obtains the second allowable difference for color matching during final printing from the reference value and the second allowable ratio for color matching during final printing, wherein said ink supply amount adjustment means selects one of a first mode during final printing to adjust the ink supply amount when the measurement difference is larger than the first allowable difference for color matching during final printing, a second mode during final printing to adjust the ink supply amount when the measurement difference is larger than the second allowable difference for color matching during final printing, and a third mode during final printing to adjust the ink supply amount when the measurement difference is larger than the first allowable difference for color matching during final printing and smaller than the second allowable difference for color matching during final printing.

* * * * *